US011144001B2

(12) United States Patent
Sakaguchi et al.

(10) Patent No.: US 11,144,001 B2
(45) Date of Patent: Oct. 12, 2021

(54) IMAGE FORMING APPARATUS HAVING MOVING MECHANISMS TO MOVE DEVELOPING ROLLERS TO BE IN CONTACT WITH AND SEPARATED FROM PHOTOSENSITIVE DRUMS

(71) Applicant: BROTHER KOGYO KABUSHIKI KAISHA, Nagoya (JP)

(72) Inventors: Shintaro Sakaguchi, Nagoya (JP); Toshiyuki Sano, Iwakura (JP); Masahito Saeki, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 16/924,846

(22) Filed: Jul. 9, 2020

(65) Prior Publication Data

US 2021/0011416 A1 Jan. 14, 2021

(30) Foreign Application Priority Data

Jul. 10, 2019 (JP) ..... JP2019-128507

(51) Int. Cl.
*G03G 15/00* (2006.01)
*G03G 15/02* (2006.01)

(52) U.S. Cl.
CPC ..... *G03G 15/6558* (2013.01); *G03G 15/0216* (2013.01); *G03G 15/6552* (2013.01)

(58) Field of Classification Search
CPC ..... G03G 15/6558; G03G 15/0216; G03G 15/6552; G03G 15/0126; G03G 15/50
See application file for complete search history.

(56) References Cited

U.S. PATENT DOCUMENTS

2008/0191413 A1 8/2008 Fujita et al.
2010/0303492 A1* 12/2010 Furukawa ..... G03G 15/065 399/55
2010/0316400 A1* 12/2010 Murasaki ..... G03G 15/50 399/49

FOREIGN PATENT DOCUMENTS

JP 2008-195509 A 8/2008
JP 2010-197463 A 9/2010
JP 2012-128017 A 7/2012

* cited by examiner

*Primary Examiner* — Sandra Brase
(74) *Attorney, Agent, or Firm* — Scully, Scott, Murphy & Presser, PC

(57) ABSTRACT

In an image forming apparatus, a first photosensitive drum is disposed upstream of a second photosensitive drum in a conveyance direction. Each of first and second developing rollers is movable between a contact position contacting a corresponding photosensitive drum and a separated position separated from the corresponding photosensitive drum. In a first case where a color print process is executed, a first moving mechanism starts moving the first developing roller toward the contact position, a manual feed roller starts picking up the sheet on a manual feed tray, and a second moving mechanism starts moving the second developing roller toward the contact position. In a second case where the monochrome print process is executed, the manual feed roller starts picking up the sheet on the manual feed tray, and the second moving mechanism starts moving the second developing roller toward the contact position.

12 Claims, 16 Drawing Sheets

IMAGE FORMING APPARATUS HAVING MOVING MECHANISMS TO MOVE DEVELOPING ROLLERS TO BE IN CONTACT WITH AND SEPARATED FROM PHOTOSENSITIVE DRUMS

CROSS REFERENCE TO RELATED APPLICATION

This application claims priority from Japanese Patent Application No. 2019-128507 filed on Jul. 10, 2019. The entire content of the priority application is incorporated herein by reference.

TECHNICAL FIELD

The present disclosure relates to an image forming apparatus including a plurality of photosensitive drums and a plurality of developing rollers capable of contacting and separating from the respective photosensitive drums.

BACKGROUND

A conventional image forming apparatus includes a plurality of photosensitive drums and a plurality of developing rollers. In the image forming apparatus, each of the plurality of developing rollers can contact and separate from a corresponding one of the photosensitive drums arranged in a sheet conveyance direction. When performing color printing in the image forming apparatus, the developing rollers sequentially contact the respective photosensitive drums. When performing monochrome printing, one developing roller contacts its corresponding photosensitive drum. Another conventional image forming apparatus includes a plurality of trays, such as a paper cassette and a manual feed tray, to support sheets. This image forming apparatus has a plurality of feeding paths to convey sheets from respective ones of the trays to a transfer position where a toner image developed on a photosensitive dram is transferred to the sheet. The image forming apparatus controls a time to pick up a sheet depending on a time period to convey a sheet via one of the sheet feeding paths.

SUMMARY

In a case where a first photosensitive drum and a second photosensitive drum are disposed in this order from an upstream side to a downstream side in a sheet conveyance direction, the distance between a manual feed tray and the first photosensitive drum along a sheet conveyance path is smaller than the distance between the manual feed tray and the second photosensitive drum along the sheet conveyance path. Nevertheless, a first developing roller needs to contact the corresponding first photosensitive drain before a sheet supplied from the manual feed tray reaches the first photosensitive drum. To make the first developing roller contact the first photosensitive drum in time, one conceivable method is to pick up the sheet from the manual feed tray after all developing rollers contact corresponding photosensitive drums. However, in this method, the second developing roller is in contact with the corresponding second photosensitive drum way before the sheet reaches the second photosensitive drum. This prolongs a situation where the second developing roller is in contact with the second photosensitive drum.

In view of the foregoing, it is an object of the present disclosure to provide an image forming apparatus capable of reducing duration of contact time between developing rollers and corresponding photosensitive drums, while allowing a first developing roller to contact a corresponding first photosensitive drum sufficiently before a sheet supplied from a manual feed tray reaches the first photosensitive drum.

In order to attain the above and other objects, the disclosure provides an image forming apparatus. The image fainting apparatus includes a manual feed tray, a manual feed roller, a plurality of photosensitive drums, a plurality of developing rollers, a first moving mechanism, a second moving mechanism, and a controller. The manual feed tray is configured to support a sheet. The manual feed roller is configured to pick up the sheet supported on the manual feed tray to convey the sheet along a conveyance path. On the plurality of photosensitive drums electrostatic latent images are capable of being formed. The plurality of photosensitive drums is arranged along the conveyance path on which a sheet is conveyed in a conveyance direction. The plurality of photosensitive drums includes a first photosensitive drum and a second photosensitive drum disposed downstream of the first photosensitive drum in the conveyance direction. The plurality of developing rollers is configured to supply respective ones of the plurality of photosensitive drums with toner to form toner images based on the electrostatic latent images. The plurality of photosensitive rollers includes a first developing roller and a second developing roller configured to supply corresponding ones of the first photosensitive drum and the second photosensitive drum with toner. Each of the plurality of developing rollers is movable between a corresponding contact position at which the each of the plurality of developing rollers contacts a corresponding photosensitive drum and a corresponding separated position at which the each of the plurality of developing rollers is separated from the corresponding photosensitive drum. The first moving mechanism is configured to move the first developing roller from a first contact position to a first separated position and from the first separated position to the first contact position. The second moving mechanism is configured to move the second developing roller from a second contact position to a second separated position and from the second separated position to the second contact position. The controller is configured to perform: a color print process for printing a color image on a sheet by using the plurality of developing rollers; a monochrome print process for printing a monochromatic image on a sheet by using only the second developing roller among the plurality of developing rollers; in a first case where the color print process is executed for printing a color image on a sheet conveyed from the manual feed tray: controlling the first moving mechanism to start moving the first developing roller from the first separated position toward the first contact position; controlling the manual feed roller to start picking up the sheet supported on the manual feed tray after the controlling the first moving mechanism is executed; and controlling the second moving mechanism to start moving the second developing roller from the second separated position toward the second contact position after the controlling the manual feed roller is executed; and in a second case where the monochrome print process is executed for printing a monochromatic image on a sheet conveyed from the manual feed tray: controlling the manual feed roller to start picking up the sheet supported on the manual feed tray; and controlling the second moving mechanism to start moving the second developing roller from the second separated position toward the second contact position after the controlling the manual feed roller is executed.

According to another aspect, the disclosure provides an image forming apparatus. The image forming apparatus includes a conveyor, a pick-up roller, a first photosensitive drum, a second photosensitive drum, a first developing roller, a second developing roller, a first moving mechanism, a second moving mechanism, and a controller. The conveyor is configured to convey a sheet along a conveyance path in a conveyance direction. The sheet tray is configured to support a sheet. The pick-up roller is configured to pick up the sheet supported on the sheet tray. The first photosensitive drum is arranged along the conveyance path. The second photosensitive drum is arranged along the conveyance path. The second photosensitive drum is disposed downstream of the first photosensitive drum in the conveyance direction. The first developing roller is movable between a first contact position at which the first developing roller contacts the first photosensitive drum and a first separated position at which the first developing roller is separated from the first photosensitive drum. The second developing roller is movable between a second contact position at which the second developing roller contacts the second photosensitive drum and a second separated position at which the second developing roller is separated from the second photosensitive drum. The first moving mechanism is configured to move the first developing roller from a first contact position to a first separated position and from the first separated position to the first contact position. The second moving mechanism is configured to move the second developing roller from a second contact position to a second separated position and from the second separated position to the second contact position. The controller is configured to perform: a color print process for printing a color image on a sheet by using both the first developing roller and the second developing roller; a monochrome print process for printing a monochromatic image on a sheet by using only the second developing roller; in a first case where the color print process is executed for printing a color image on a sheet conveyed from the sheet tray: controlling the first moving mechanism to start moving the first developing roller from the first separated position toward the first contact position; controlling the pick-up roller to start picking up the sheet supported on the sheet tray after the controlling the first moving mechanism is executed; and controlling the second moving mechanism to start moving the second developing roller from the second separated position toward the second contact position after the controlling the pick-up roller is executed; and in a second case where the monochrome print process is executed for printing a monochromatic image on a sheet conveyed from the sheet tray: controlling the pick-up roller to start picking up the sheet supported on the sheet tray; and controlling the second moving mechanism to start moving the second developing roller from the second separated position toward the second contact position after the controlling the pick-up roller is executed.

According to still another aspect, the disclosure provides an image forming apparatus. The image forming apparatus includes a sheet tray, a pick-up roller, a first photosensitive drum, second photosensitive drum, a first developing roller, a second developing roller, and a controller. The pick-up roller is configured to pick up a sheet on the sheet tray. The first developing roller is movable between: a first contact position at which the first developing roller contacts the first photosensitive drum; and a first separated position at which the first developing roller is separated from the first photosensitive drum. The second developing roller being movable between: a second contact position at which the second developing roller contacts the second photosensitive drum; and a second separated position at which the second developing roller is separated from the second photosensitive drum. The controller is configured to perform: when printing image on a sheet picked up from the sheet tray by using both the first developing roller and the second developing roller; starting moving the first developing roller from the first separated position toward the first contact position; after starting moving the first developing roller, starting picking up the sheet supported on the sheet tray by the pick-up roller; and after starting picking up the sheet, starting moving the second developing roller front the second separated position toward the second contact position; and when printing image on a sheet picked up front the sheet tray by using only the second developing roller; starting picking up the sheet supported on the sheet tray by the pick-up roller; and after starting picking up the sheet, starting moving the second developing roller from the second separated position toward the second contact position.

BRIEF DESCRIPTION GF THE DRAWINGS

The particular features and advantages of the disclosure as well as other objects will become apparent from the following description taken in connection with the accompanying drawings, in which.

Figure 6A:
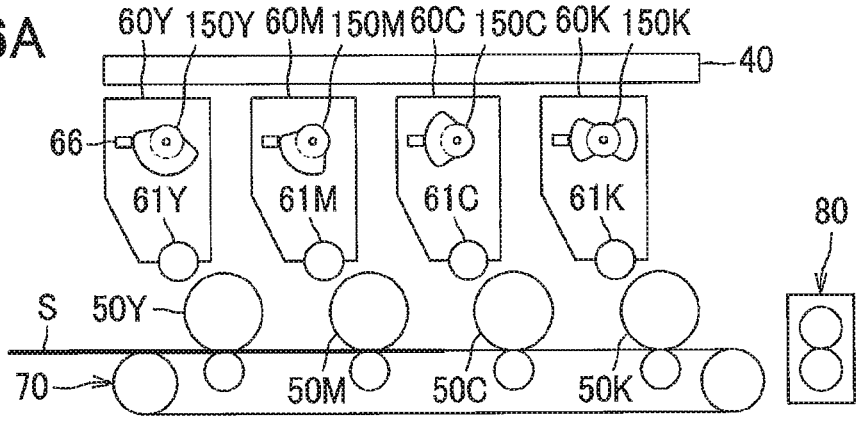
Figure 6B:
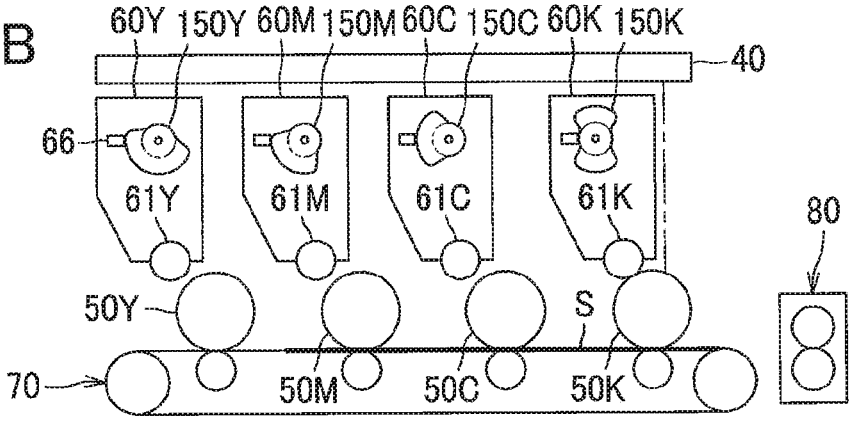
Figure 6C:
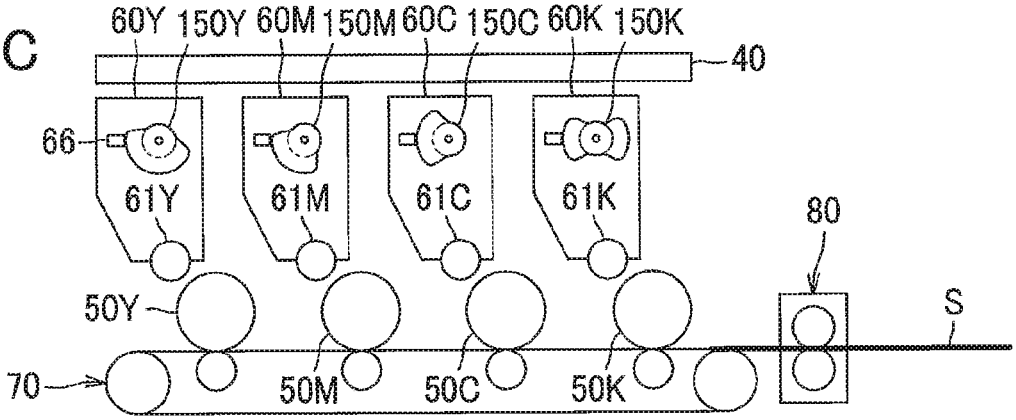
Figure 7A:
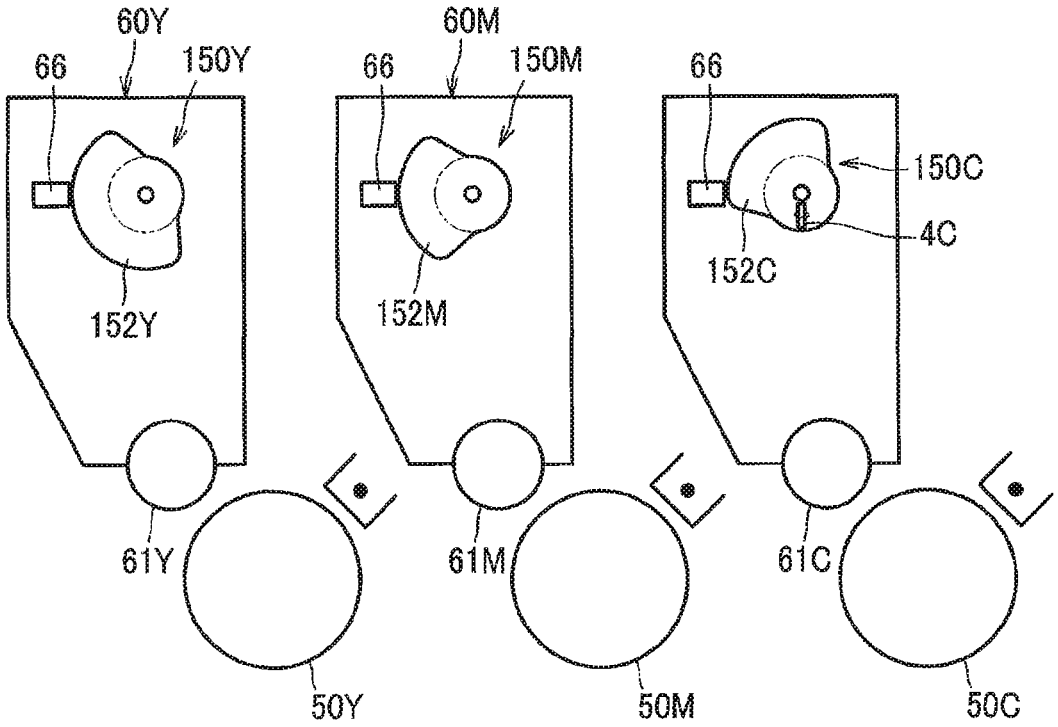
Figure 7B:
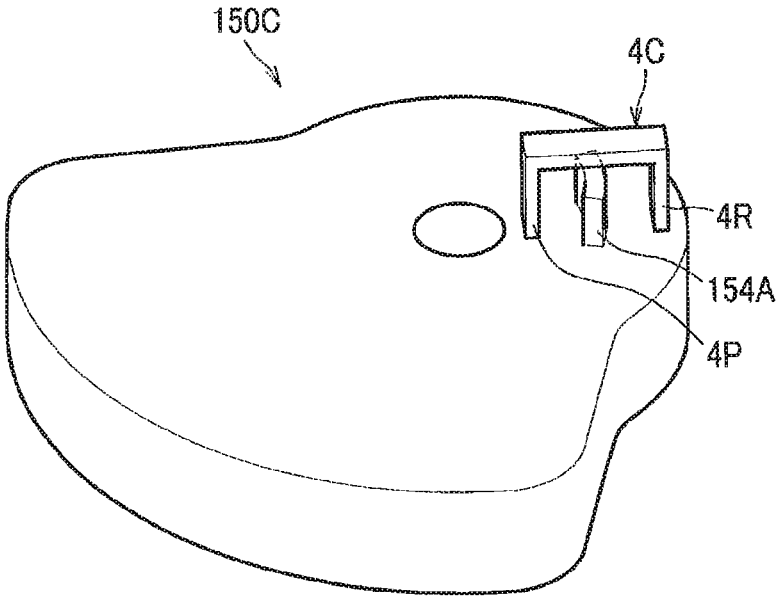
Figure 8A:
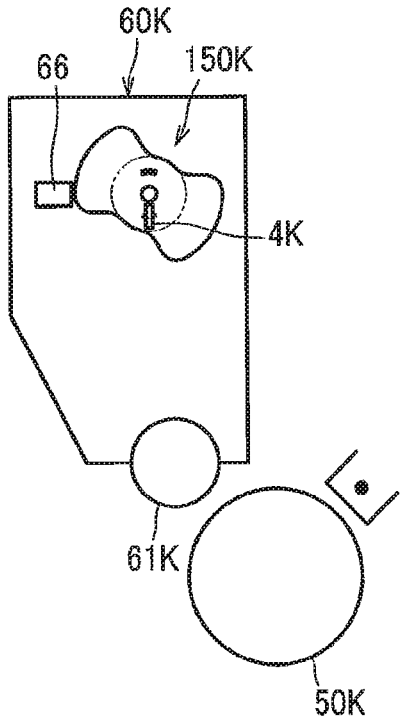
Figure 8B:
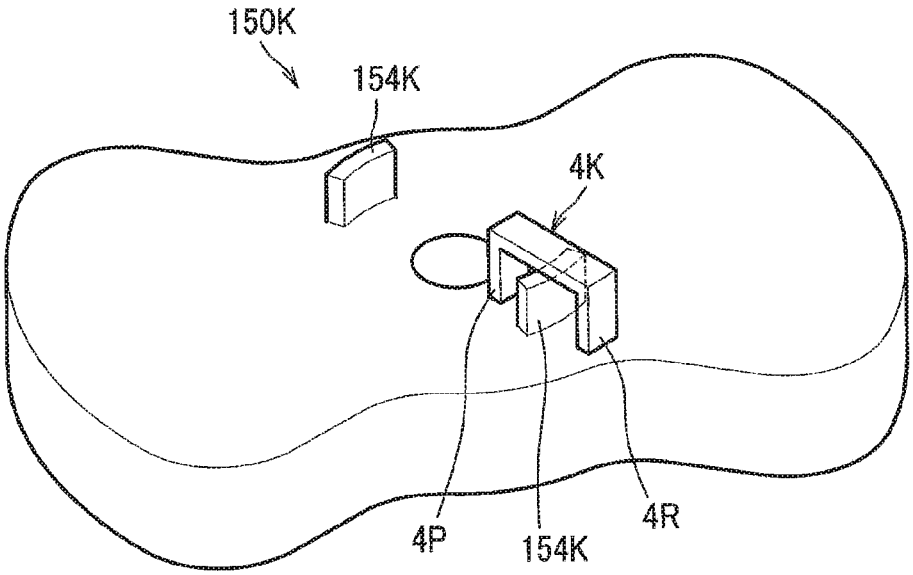
Figure 9:
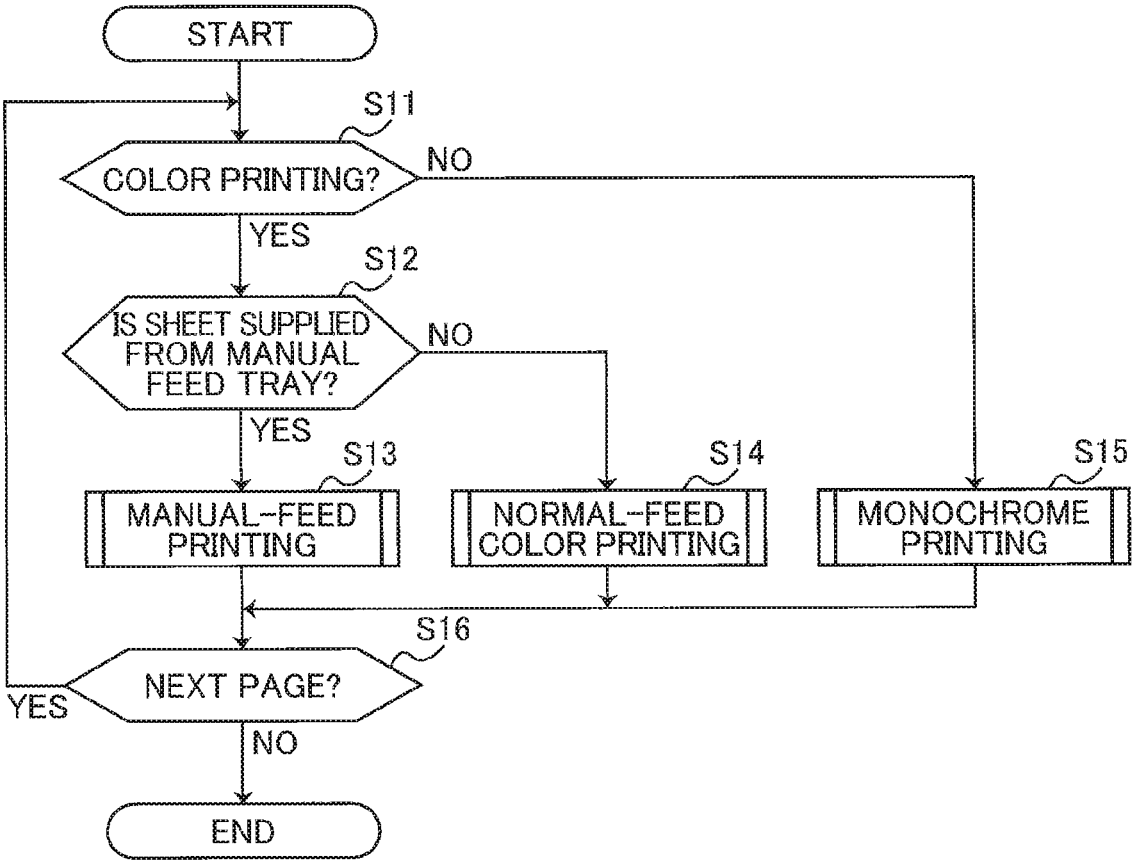
Figure 10:
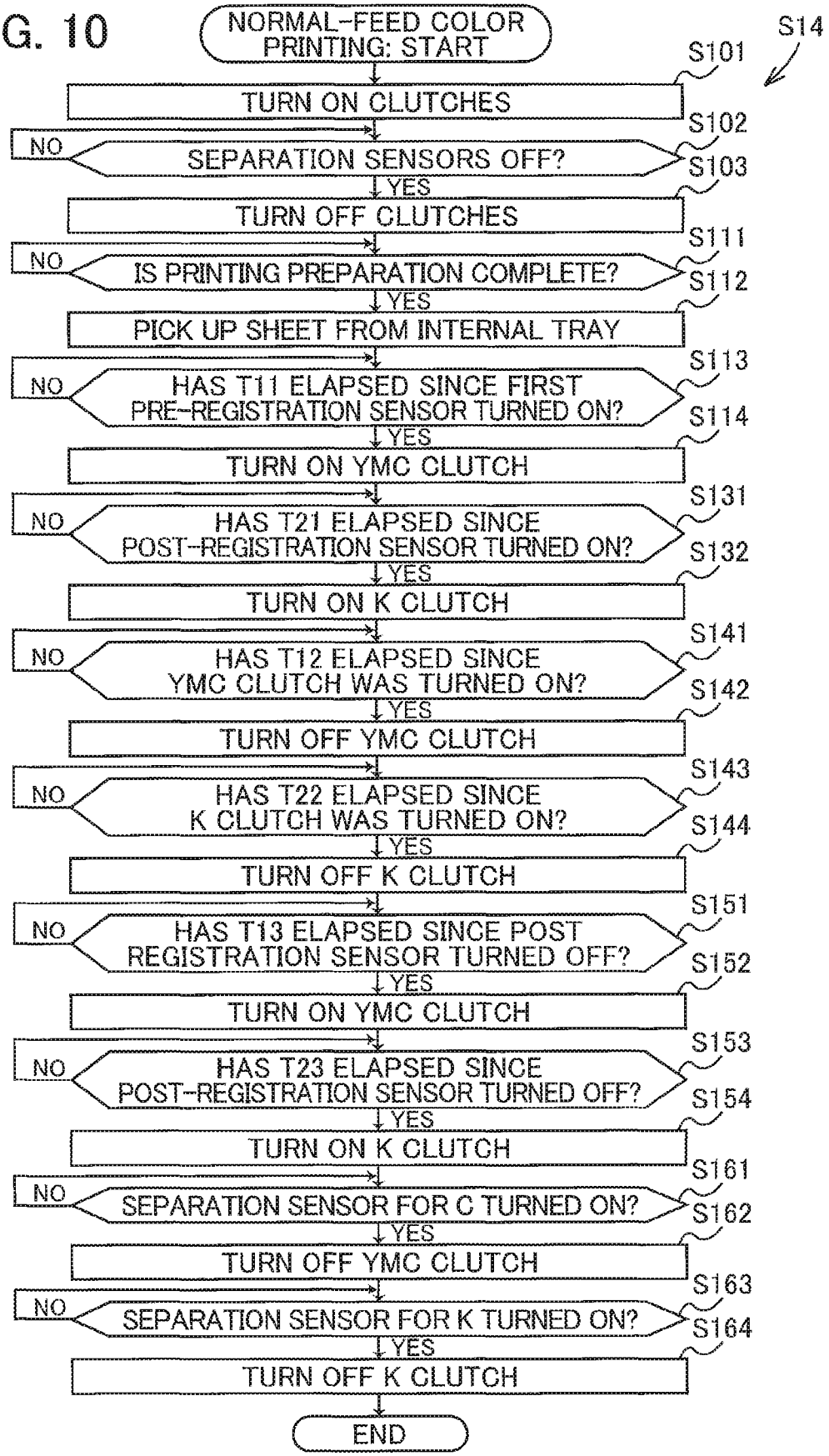
Figure 11:
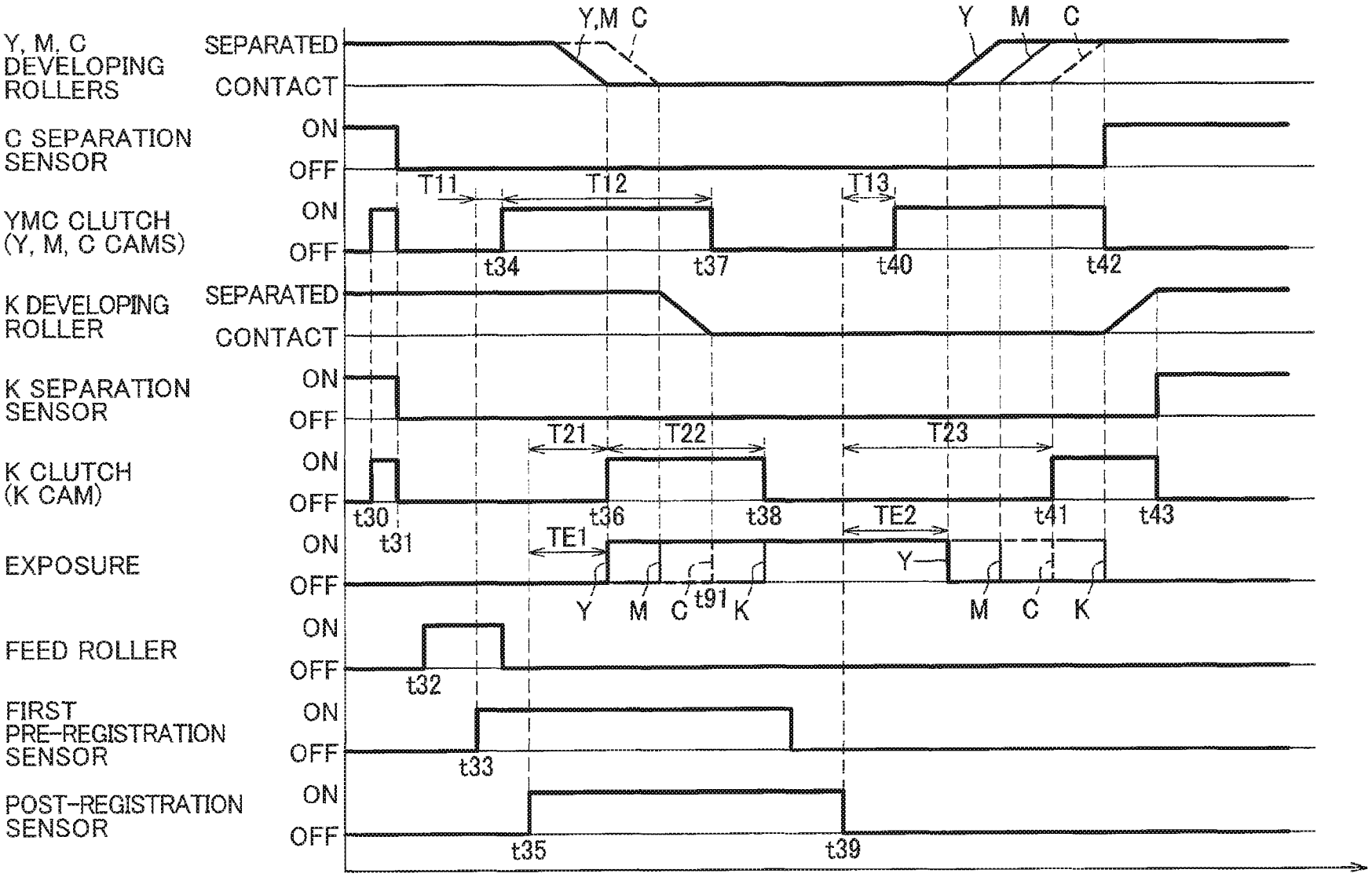
Figure 12:
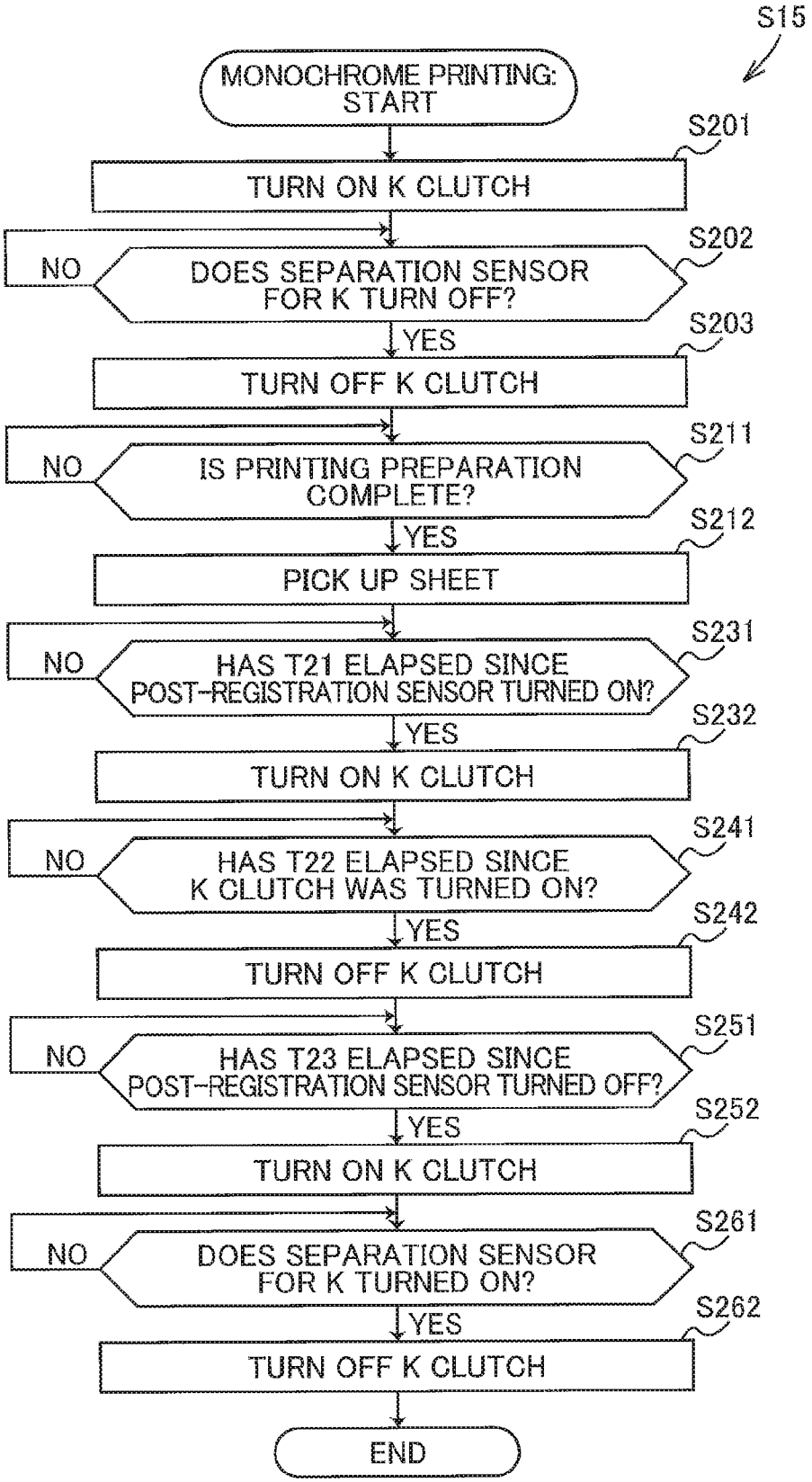
Figure 13:
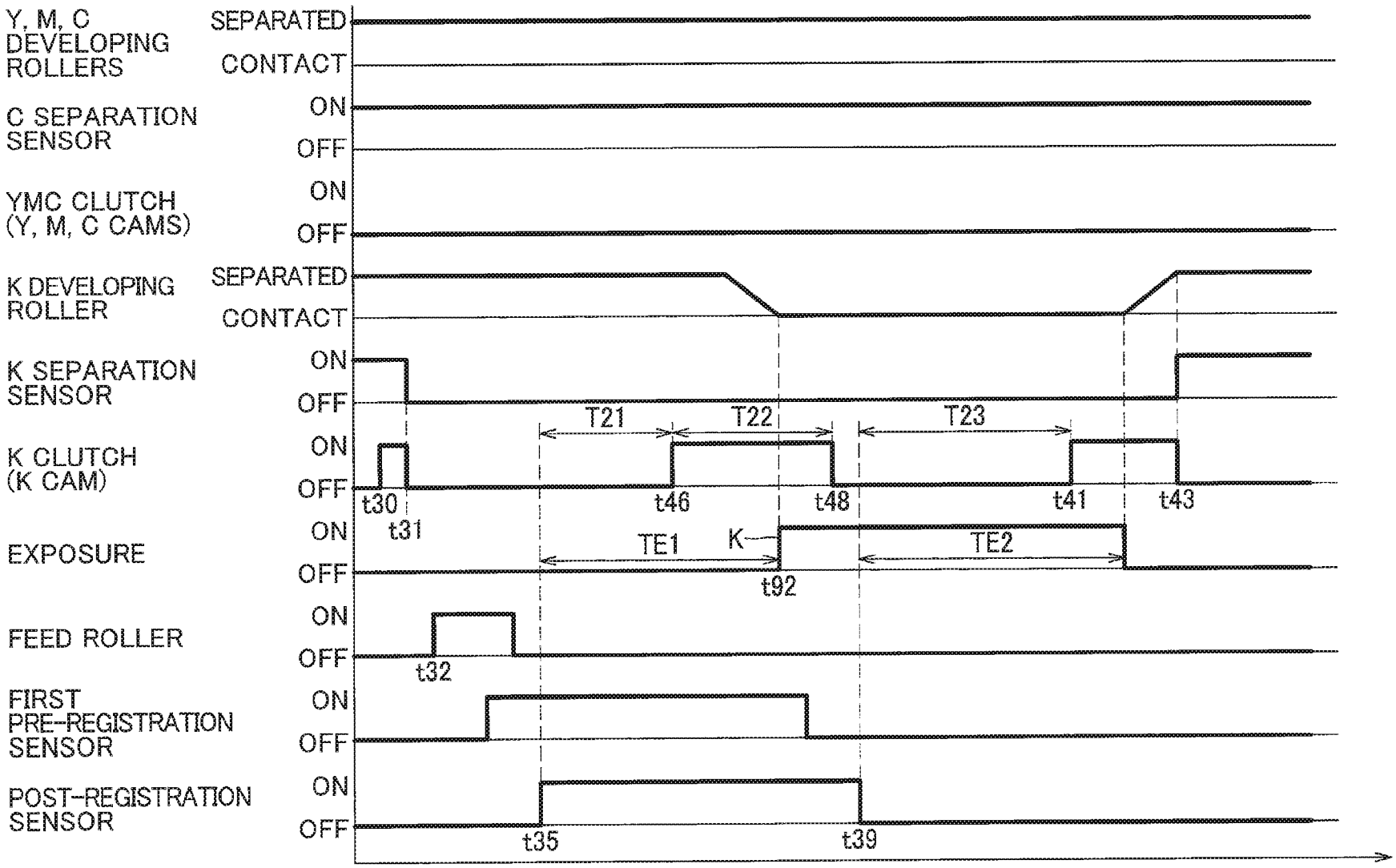
Figure 14:
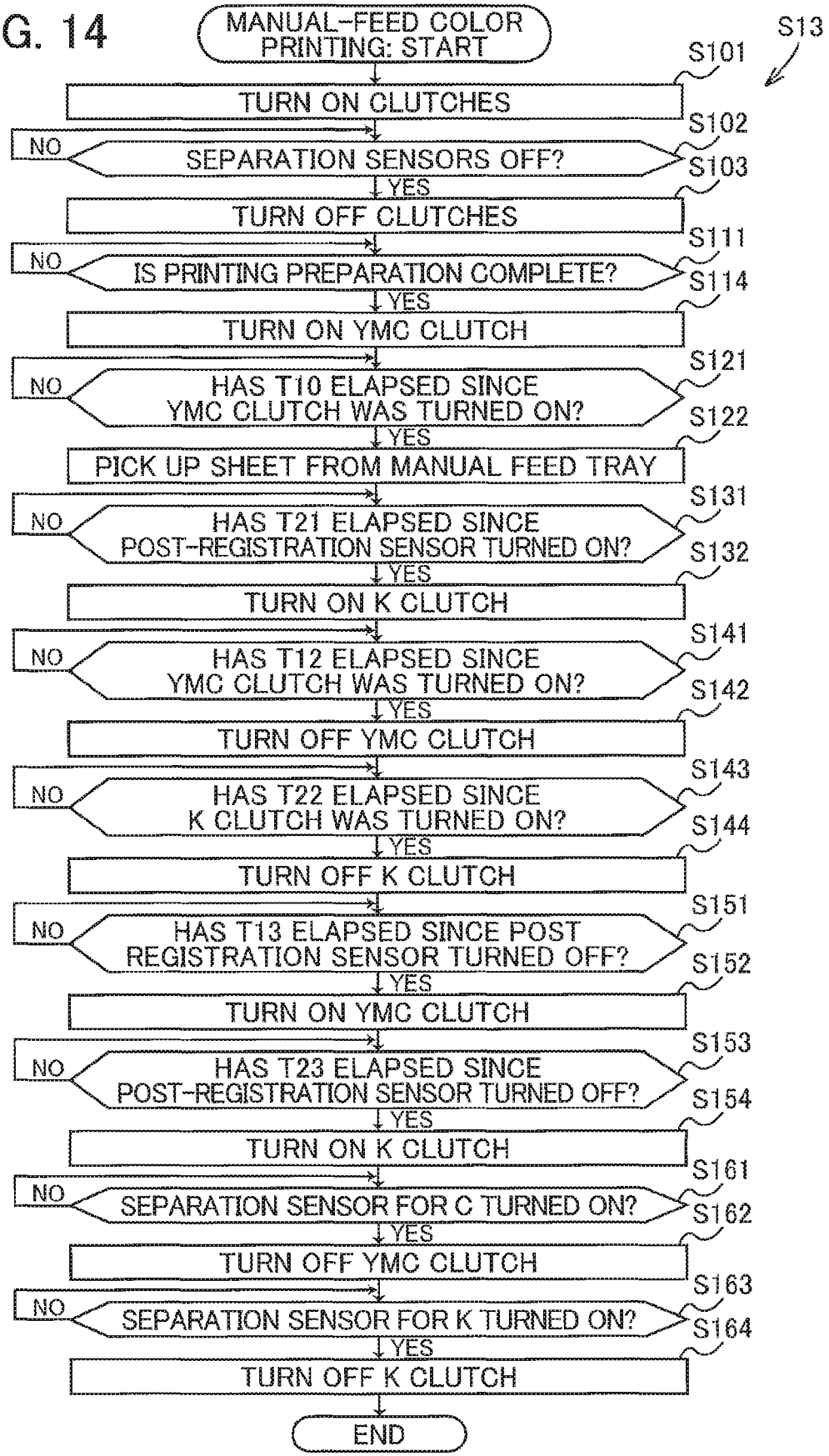
Figure 15:
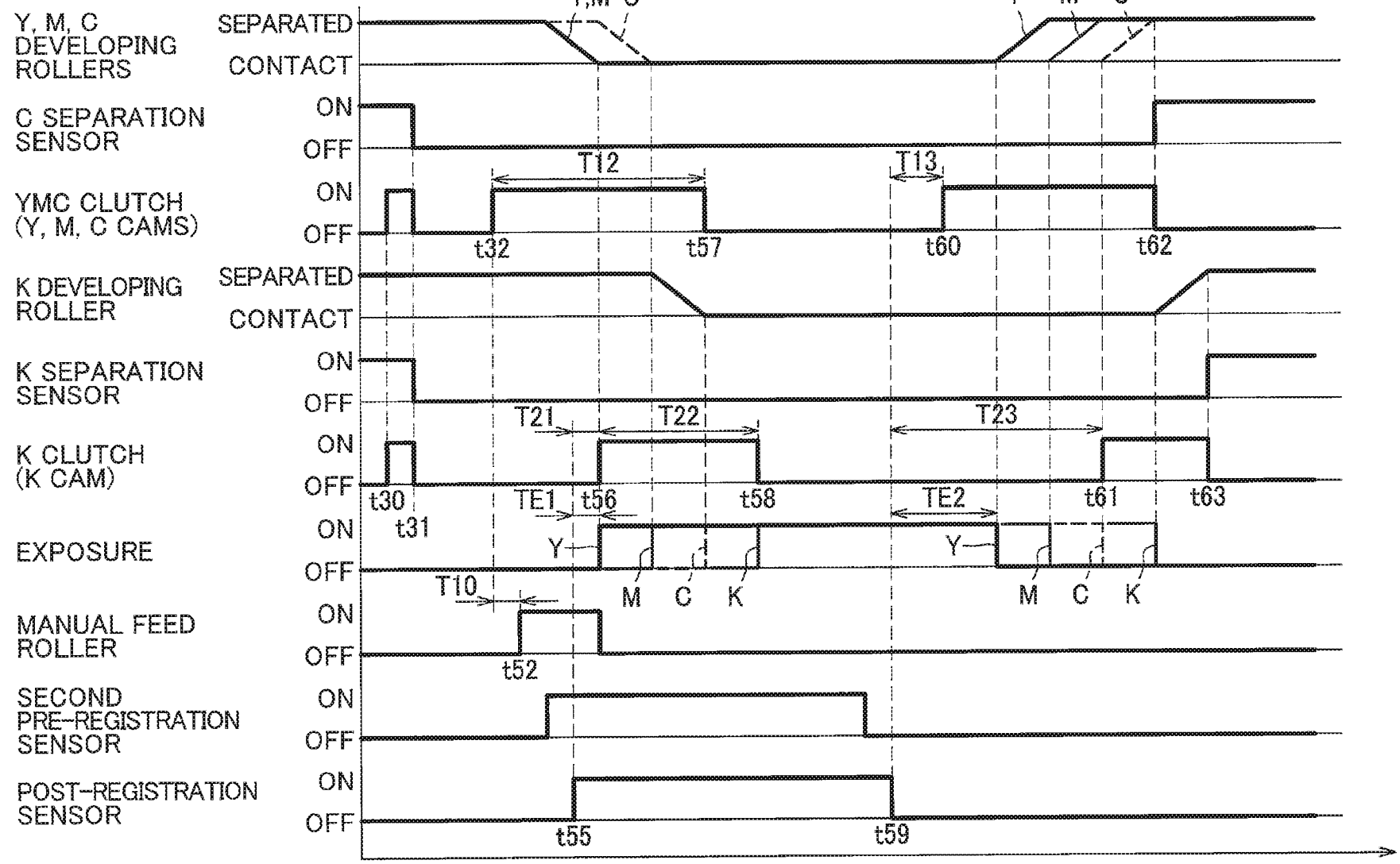
Figure 16:
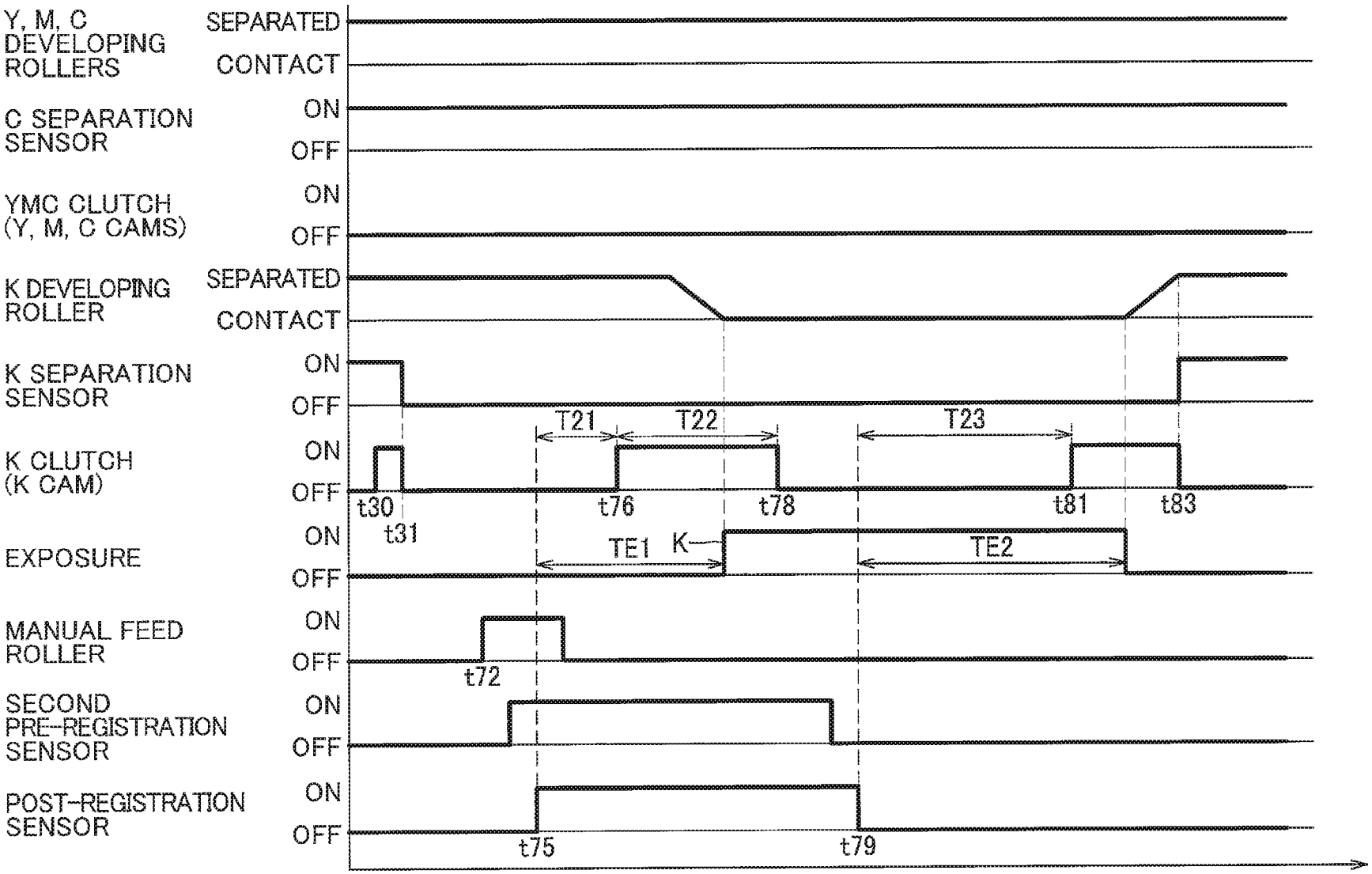

FIGS. 5A-5D explanation diagrams illustrating latter half of operations of the developing rollers when the color printing is executed;

FIGS. 6A-6C are explanation diagrams illustrating operations of the developing rollers when monochrome printing is executed;

FIG. 7A is an explanatory diagram illustrating the cams for colors of yellow, magenta, and cyan and a separation sensor for the color of cyan;

FIG. 7B is a perspective view illustrating a first detected portion provided in the cam for the color of cyan;

FIG. 8A is an explanatory diagram illustrating the cant for color of black and a separation sensor for the color of black;

FIG. 8B is a perspective view illustrating a second detected portion provided in the cam for the color of black;

FIG. 9 is a flowchart illustrating a process when a print job is received;

FIG. 10 is a flowchart illustrating a process for normal-feed color printing in which a sheet is fed from an internal tray;

FIG. 11 is a timing chart illustrating operations of the developing rollers, clutches, and a feed roller in the process for normal-feed color printing shown in FIG. 10;

FIG. 12 is a flowchart illustrating a process for monochrome printing;

FIG. 13 is a timing chart illustrating operations of the developing rollers, the clutches, and the feed roller in the process for monochrome printing when a sheet is fed from the internal tray;

FIG. 14 is a flowchart illustrating a process for manual feed printing in which a sheet is fed from a manual feed tray;

FIG. 15 is a timing chart illustrating operations of the developing rollers, the clutches, and a manual feed roller in the process for manual-feed color printing shown in FIG. 14; and FIG. 16 is a timing chart illustrating operations of the developing rollers, the clutches, and the manual feed roller in the process for monochrome printing when a sheet is fed from the manual feed tray.

DETAILED DESCRIPTION

Figure 1:
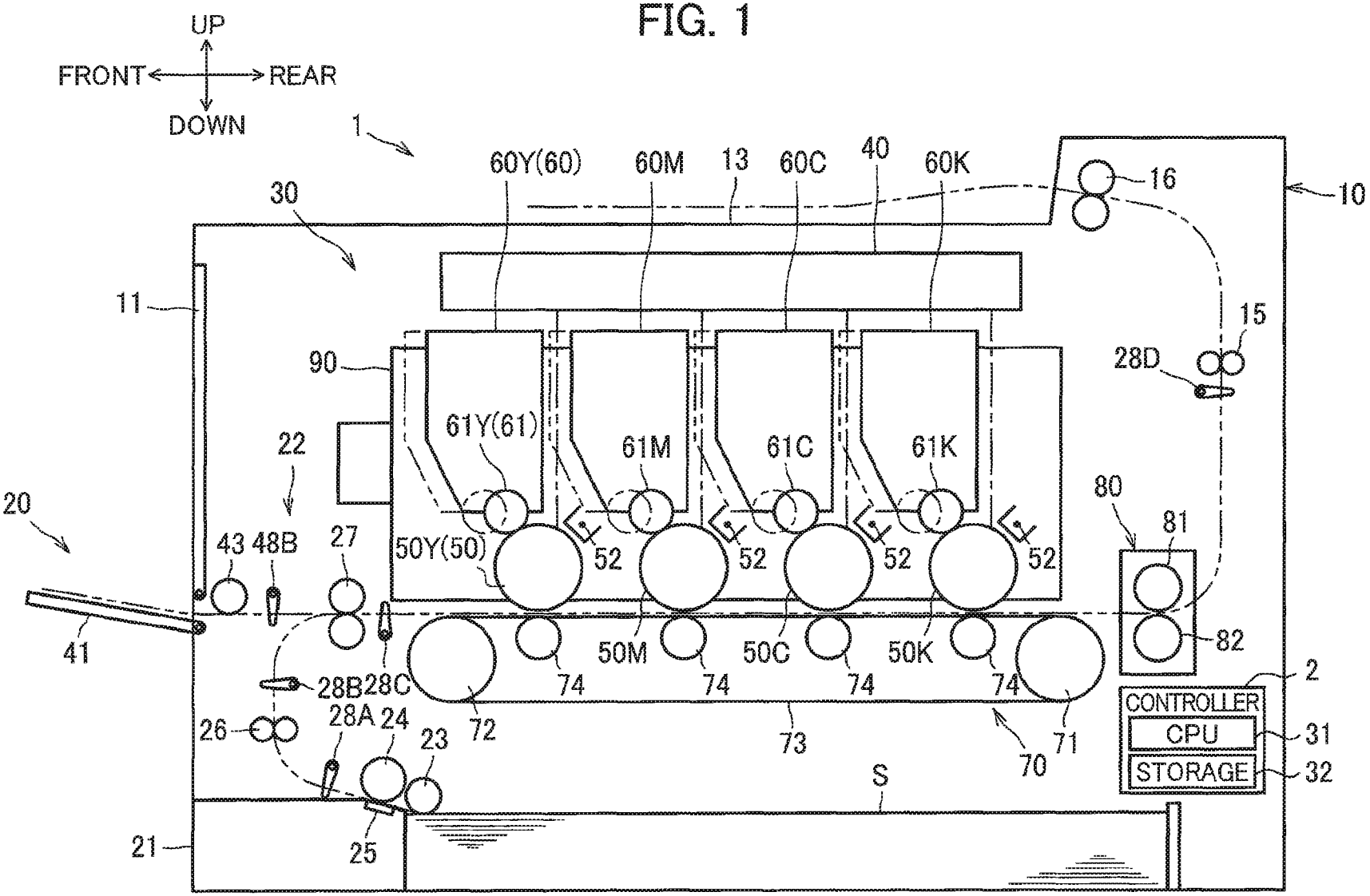
FIG. 1 is a schematic diagram illustrating an image forming apparatus according to an embodiment.

As illustrated in FIG. 1, an image forming apparatus 1 according to an embodiment is a color printer and includes a housing 10, a sheet feeder 20, an image forming portion 30, and a controller 2. Left and right sides of FIG. 1 are defined as front and rear sides of the image forming apparatus 1, respectively. Upper and lower sides of FIG. 1 are defined as upper and lower sides of the image forming apparatus 1, respectively. Near and far sides of the sheet of FIG. 1 are defined as right and left sides of the image forming apparatus 1, respectively.

The sheet feeder 20 includes an internal tray 21 (sheet cassette), a manual feed tray 41, and a feeding mechanism 22, The internal tray 21 and the manual feed tray 41 support sheets S. The internal tray 21 is disposed below the image forming portion 30 in the housing 20. By pulling the internal tray 21 to the front side of the housing 10, the internal tray 21 can be removed from the housing 10. The manual feed tray 41 is disposed on a front side of the housing 10 and in front of the image forming portion 30. A user can put sheets on the manual feed tray 41 without any operations such as opening a cover of the image forming apparatus 1 or pulling any part of the image forming apparatus 1 to the outside of the housing 10. The distance between the internal tray 21 and a photosensitive drum 50 (Y photosensitive drum 50Y) along a corresponding conveyance path of a sheet is longer than the distance between the manual feed tray 41 and the Y photosensitive drum 50Y along a corresponding conveyance path of a sheet S.

The feeding mechanism 22 includes a feed roller 23, a separation roller 24, a separation pad 25, conveying rollers 26, registration rollers 27, and a manual feed roller 43. The feed roller 23 picks up a sheet S supported by the internal tray 21. The manual feed roller 43 picks up a sheet S supported by the manual feed tray 41. For example, sheets S are media, such as plain sheets, envelopes, postcards, thin sheets, thick sheets, glossy sheets, resin sheets, and stickers, on which the image forming apparatus 1 can form an image.

The sheets S in the internal tray 21 are fed by the feed roller 23 and then separated one by one between the separation roller 24 and the separation pad 25. The conveying rollers 26 convey the separated sheet S toward the registration rollers 27. On the other hand, the sheets S on the manual feed tray 41 are fed by the manual feed roller 43 to the registration rollers 27.

When the sheet S reaches the registration rollers 27, the registration rollers 27 in a stopped state regulate the position of a leading end of the sheet S. After that, the registration rollers 27 start rotating, supplying the sheet S to the image forming portion 30.

The image forming apparatus 1 includes a sheet feed sensor 28A, a first pre-registration sensor 28B, a second pre-registration sensor 48B, and a post-registration sensor 28C. The sheet feed sensor 28A, the first pre-registration sensor 28B, the second pre-registration sensor 48B, and the post-registration sensor 28C can detect presence or not presence of a sheet S and output signals depending on the detections toward the controller 2 so that the controller 2 determines the passage of the sheet S. The sheet feed sensor 28A is disposed on a downstream side of the feed roller 23 and the separation roller 24 in a conveyance direction in which a sheet S is conveyed.

The first pre-registration sensor 28B is disposed on a downstream side of the internal tray 21 and on an upstream side of the Y photosensitive drum 50Y in the conveyance direction. Specifically, the first pre-registration sensor 28B is disposed on a downstream side of the sheet feed sensor 28A and the conveying rollers 26 and on an upstream side of the registration rollers 27 in the conveyance direction.

The second pre-registration sensor 48B is disposed on a downstream side of the manual feed tray 41 and the manual feed roller 43 and on an upstream side of the registration rollers 27 in the conveyance direction.

The conveyance path from the manual feed roller 43 joins the conveyance path from the internal tray 21 at a joining position which is between the registration rollers 27 and the first pre-registration sensor 28B on the conveyance path from the internal tray 21 and is also between the registration rollers 27 and the second pre-registration sensor 48B on the conveyance path from the manual feed tray 41.

The post-registration sensor 28C is disposed on a downstream side of the registration rollers 27 and on the upstream side of the Y photosensitive drum 50Y in the conveyance direction. In the present embodiment, the post-registration sensor 28C corresponds to a "first sheet sensor", while the first pre-registration sensor 28B corresponds to a "second sheet sensor".

The image forming portion 30 includes an exposure device 40, a plurality of photosensitive drums 50, a plurality of developing cartridges 60, a conveyor 70, and a fixing device 80. The exposure device 40 includes a laser diode, a deflector, a lens, and a mirror, not illustrated. As illustrated in FIG. 1, the exposure device 40 exposes the surfaces of the plurality of photosensitive drums 50 by irradiating those surfaces with a plurality of light beams indicated by dashed-dotted lines.

The plurality of photosensitive drums 50 includes the Y photosensitive drum 50Y, an M photosensitive drum 50M, a C photosensitive drum 50C, and a K photosensitive drum 50K. The Y photosensitive drum SOY corresponds to yellow. The M photosensitive drum 50M corresponds to magenta. The C photosensitive drum 50C corresponds to cyan. The K photosensitive drum 50K corresponds to black. In the present embodiment, the Y photosensitive drum 50Y corresponds to a "first photosensitive drum", the M photosensitive drum 50M corresponds to a "third photosensitive drum", the C photosensitive drum 50C corresponds to a "fourth photosensitive drum", and the K photosensitive drum 50K corresponds to a "second photosensitive drum". In the following description and drawings, any components corresponding to yellow, magenta, cyan, and black are denoted with reference signs followed by letters Y, M, C, and K, respectively. When those components do not need to be distinguished from each other, the components are denoted without the letters Y, M, C, and K.

The Y photosensitive drum 50Y, the M photosensitive drum 50M, the C photosensitive drum 50C, and the K photosensitive drum 50K are disposed in this order from the upstream side to the downstream side in the conveyance direction. Specifically, the K photosensitive drum 50K is disposed on a downstream side of the Y photosensitive drum 50Y in the conveyance direction. The M photosensitive drum 50M is disposed between the Y photosensitive drum 50Y and the K photosensitive drum 50K in the conveyance direction. The C photosensitive drum 50C is disposed between the M photosensitive drum 50M and the K photosensitive drum 50K in the conveyance direction.

The developing cartridges 60 accommodate toner therein are disposed in one-to-one correspondence with the photosensitive drums 50. The developing cartridges 60 include a Y developing cartridge 60Y, an M developing cartridge 60M, a C developing cartridge 60C, and a K developing cartridge 60K. The Y developing cartridge 60Y includes a Y developing roller 61Y to supply toner to the Y photosensitive drum SOY. The M developing cartridge 60M includes an M developing roller 61M to supply toner to the M photosensitive drum 50M. The C developing cartridge 60C includes a C developing roller 61C to supply toner to the C photosensitive drum 50C. The K developing cartridge 60K includes a K developing roller 61K to supply toner to the K photosensitive drum 50K.

The Y developing roller 61Y, the M developing roller 61M, the C developing roller 61C, and the K developing roller 61K are disposed in this order from the upstream side to the downstream 61Y corresponds to a "first developing roller", the M developing roller 61M corresponds to a "third developing roller", the C developing roller 61C corresponds to a "fourth developing roller", and the K developing roller 61K corresponds to a "second developing roller".

As illustrated in FIG. 1, each developing cartridge 60 is movable between a position indicated by a solid line and a position indicated by a virtual line (two-dot chain line). When the developing cartridge 60 is at the position indicated by the solid line, the corresponding developing roller 61 is at a contact position indicated by a solid line and is in contact with the corresponding photosensitive drum 50. When the developing cartridge 60 is at the position indicated by the virtual line, the corresponding developing roller 61 is at a separated position indicated by a virtual line and is separated from the corresponding photosensitive drum 50. When the M developing roller 61M, the C developing roller 61C, and the K developing roller 61K are at the separated positions, the M developing cartridge 60M, the C developing cartridge 60C, and the K developing cartridge 60K overlap with optical paths of light beams for exposing their respective adjacent photosensitive drums 50 on the upstream side in the conveyance direction. When the M developing roller 61M, the C developing roller 61C, and the K developing roller 61K are at the contact positions, the M developing cartridge 60M, the C developing cartridge 60C, and the K developing cartridge 60K do not overlap with the optical paths of these light beams.

Specifically, when the M developing roller 61M is at the separated position, the M developing cartridge 60M overlaps with the optical path of the light beam for exposing the Y photosensitive drum 50Y. When the M developing roller 61M is at the contact position, the M developing cartridge 60M does not overlap with the optical path of the light beam for exposing the Y photosensitive drum SOY When the C developing roller 61C is at the separated position, the C developing cartridge 60C overlaps with the optical path of the light beam for exposing the M photosensitive drum 50M. When the C developing roller 61C is at the contact position, the C developing cartridge 60C does not overlap with the optical path of the light beam for exposing the M photosensitive drum 50M. When the K developing roller 61K is at the separated position, the K developing cartridge 60K overlaps with the optical path of the light beam for exposing the C photosensitive drum SOC. When the K developing roller 61K is at the contact position, the K developing cartridge 60K does not overlap with the optical path of the light beam for exposing the C photosensitive drum 50C.

The plurality of photosensitive drums 50 is rotatably supported by a support member 90. The support member 90 includes chargers 52 disposed in one-to-one correspondence with the photosensitive drums 50. The chargers 52 charge the corresponding photosensitive drums 50. The support member 90 can be detached from the housing 10 when a front cover 11 of the housing 10 is opened. The support member 90 detachably supports the plurality of developing cartridges 60.

The conveyor 70 is disposed between the internal tray 21 and the plurality of photosensitive drums 50. The conveyor 70 includes a driving roller 71, a driven roller 72, a conveying belt 73, and four transfer rollers 74. The conveying belt 73 is an endless belt tightly stretched between the driving roller 71 and the driven roller 72. The conveying belt 73 has an outer surface facing the photosensitive drums 50. Each transfer roller 74 is disposed inside the conveying belt 73, sandwiching the conveying belt 73 with the corresponding photosensitive drum 50.

The fixing device 80 is disposed on a rear side of the plurality of photosensitive drums 50 and the conveyor 70. The fixing device 80 includes a heating roller 81 and a pressure roller 82 facing the heating roller 81. A sheet discharge sensor 28D, conveying rollers 15, and discharge rollers 16 are disposed on a downstream side of the fixing device 80 in the conveyance direction. The sheet discharge sensor 28D can detect presence or not presence of a sheet S and output signals depending on the detections to the controller 2 so that the controller 2 determines the passage of the sheet S.

In the image forming portion 30, after the chargers 52 uniformly charge the surfaces of the respective photosensitive drums 50, the exposure device 40 irradiates the surfaces of the photosensitive drums 50 with light beams. According to this exposure, electrostatic latent images corresponding to image data on the photosensitive drums 50 can be formed. The developing rollers 61 receive toner from the respective developing cartridges 60 and carry the toner on their surfaces. When the developing rollers 61 are at the contact positions, the developing rollers 61 supply the toner to the electrostatic latent images on the photosensitive drums 50, forming toner images on the respective photosensitive drums 50. While a sheet S on the conveying belt 73 passes between the photosensitive drums 50 and the transfer rollers 74, the toner images on the photosensitive drums 50 are transferred to the sheet S. After that, the sheet S passes between the heating roller 81 and the pressure roller 82, and the toner images are thermally fixed to the sheet S. The sheet S is then discharged onto a discharging tray 13 by the conveying rollers 15 and the discharge rollers 16.

Figure 2:
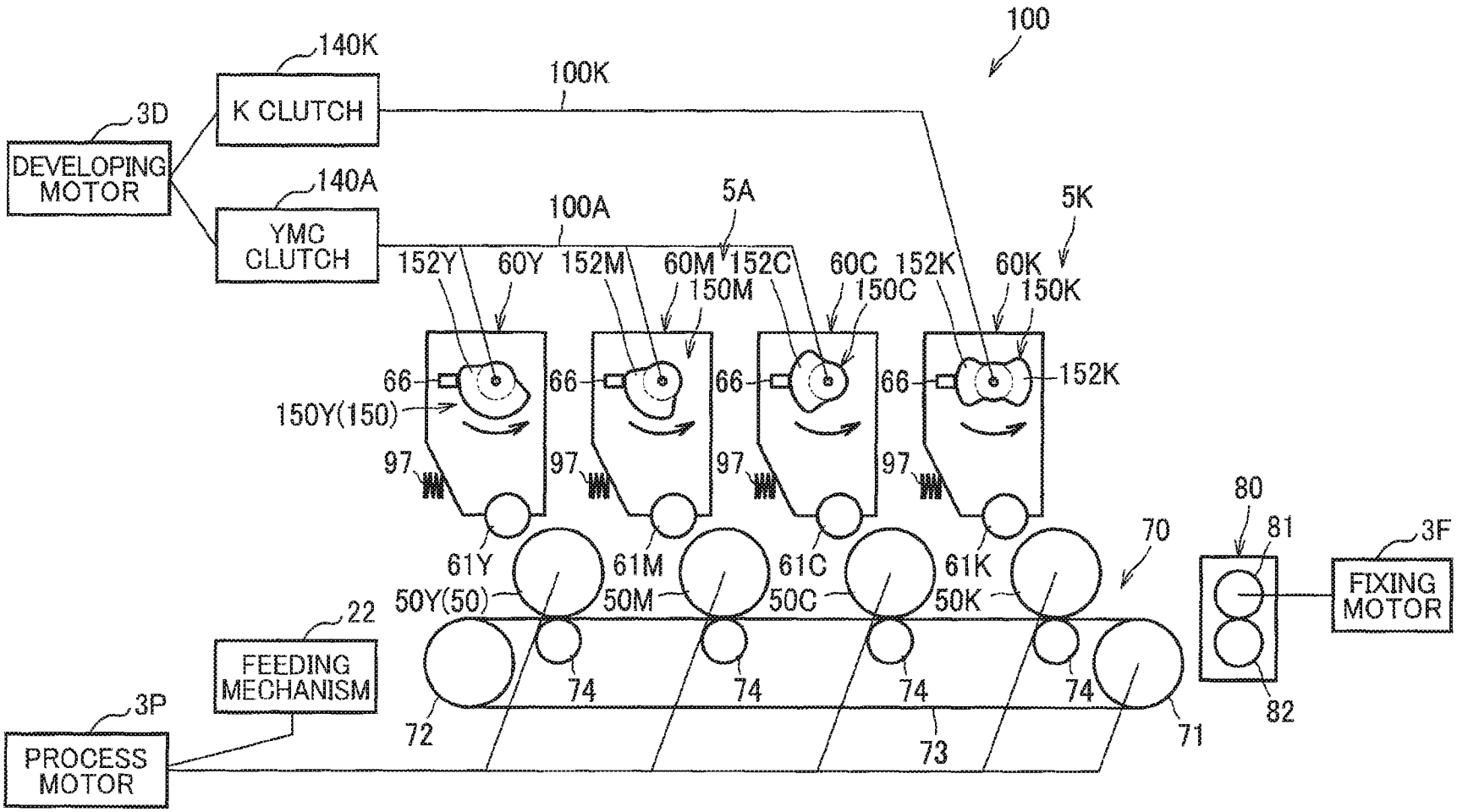
FIG. 2 is an explanatory diagram illustrating configurations for moving developing rollers so as to contact and separate from corresponding photosensitive drums.

As illustrated in FIG. 2, the image forming apparatus 1 includes a first moving mechanism 5A and a second moving mechanism 5K. The first moving mechanism 5A moves each of the Y developing roller 61Y, the M developing roller 61M, and the C developing roller 61C from the contact position to the separated position and from the separated position to the contact position. The second moving mechanism 5K moves the K developing roller 61K from the contact position to the separated position and from the separated position to the contact position. The first moving mechanism 5A includes a Y cam 150Y, M cam 150M, and a C cam 150C. The Y cam 150Y serves as a first cam and applies forces to the Y developing roller 61 so that the Y developing roller 61Y moves between the contact position and the separated position. The M cam 150M serves as a second cam and applies forces the M developing roller 61M so that the M developing roller 61M moves between the contact position and the separated position. The C cam 150C serves as a third cam and applies forces to the C developing roller 61C so that the C developing roller 61C moves between the contact position and the separated position. The second moving mechanism 5K includes a K cam 150K. The K cam 150K applies forces to the K developing roller 61K so that the K developing roller 61K moves between the contact position and the separated position.

The following description explains one example of the cams 150 (150Y, 150M, 1500, and 150K) that can move the developing rollers 61 to be contact with or separated from the respective photosensitive drums 50.

As illustrated in HG. 1, the support member 90 movably supports the developing cartridges 60 in the conveyance direction on the conveying belt 73, that is, in the direction in which the photosensitive drums 50 are arranged. Specifically, as shown in FIG. 2, the support member 90 includes springs 97. The springs 97 are disposed in one-to-one correspondence with the developing cartridges 60 and bias the respective developing cartridges 60 from the upstream side to downstream side in the conveyance direction.

A pressed portion 66 is disposed on a side surface of each developing cartridge 60 and protrudes in a direction parallel to a rotational axis of the developing roller 61. When the cam 150 presses the pressed portion 66 from the downstream side to the upstream side in the conveyance direction, the developing cartridge 60 is moved, against a biasing force of the spring 97, to a position so that the developing roller 61 is positioned at the separated position. As illustrated in FIG. 1, when the cam 150 reduce or release force pressing the pressed portion 66, the spring 97 biases the developing cartridge 60 to a position so that the developing roller 61 contacts the photosensitive drum 50 at the contact position.

Each cam 150 is rotatable about an axis parallel to the rotation axis of the corresponding developing roller 61. Cain crests 152Y, 152M, and 152C are provided on outer peripheral surfaces of the Y cam 150Y, the M cam 150M, and the C cam 150C, respectively. Each of the cam crest 152Y, 152M, and 152C is a part of the outer peripheral surface of the cam 150 that protrudes from the rotational axis more than a remaining part of the outer peripheral surface from the rotational axis. Two substantially symmetrical cam crests 152K are provided on an outer peripheral surface of the K cam 150K. The two cam crests are parts of the outer peripheral surface of the K cam 150K that protrude from the rotational axis than remaining parts from the rotational axis. The cam crests 152Y, 152M, 152C, and 152K can press the respective pressed portions 66. With the cam crests 152Y 152M, 152C, and 152K pressing the respective pressed portions 66, the developing rollers 61 are at the separated positions. With the cam crests 152Y, 152M, 152C, and 152K not pressing the respective pressed portions 66, the developing rollers 61 are at the contact positions. Rotating the cams 150 makes the respective developing rollers 61 move between the separated positions and the contact positions.

In the present embodiment, the length of the cam crest 152Y in the circumferential direction is longer than that of the cam crest 152M or 152C in the circumferential direction. The length of each cam crest 152K in the circumferential direction is shorter than that of any of the cam crests 152Y, 152M, and 152C in the circumferential direction. A configuration of the M cam 150M is the same as that of the C cam 150C. All the cams 150 rotate at substantially the same rotation speed and take substantially the same time period TR for one rotation.

Figure 3:
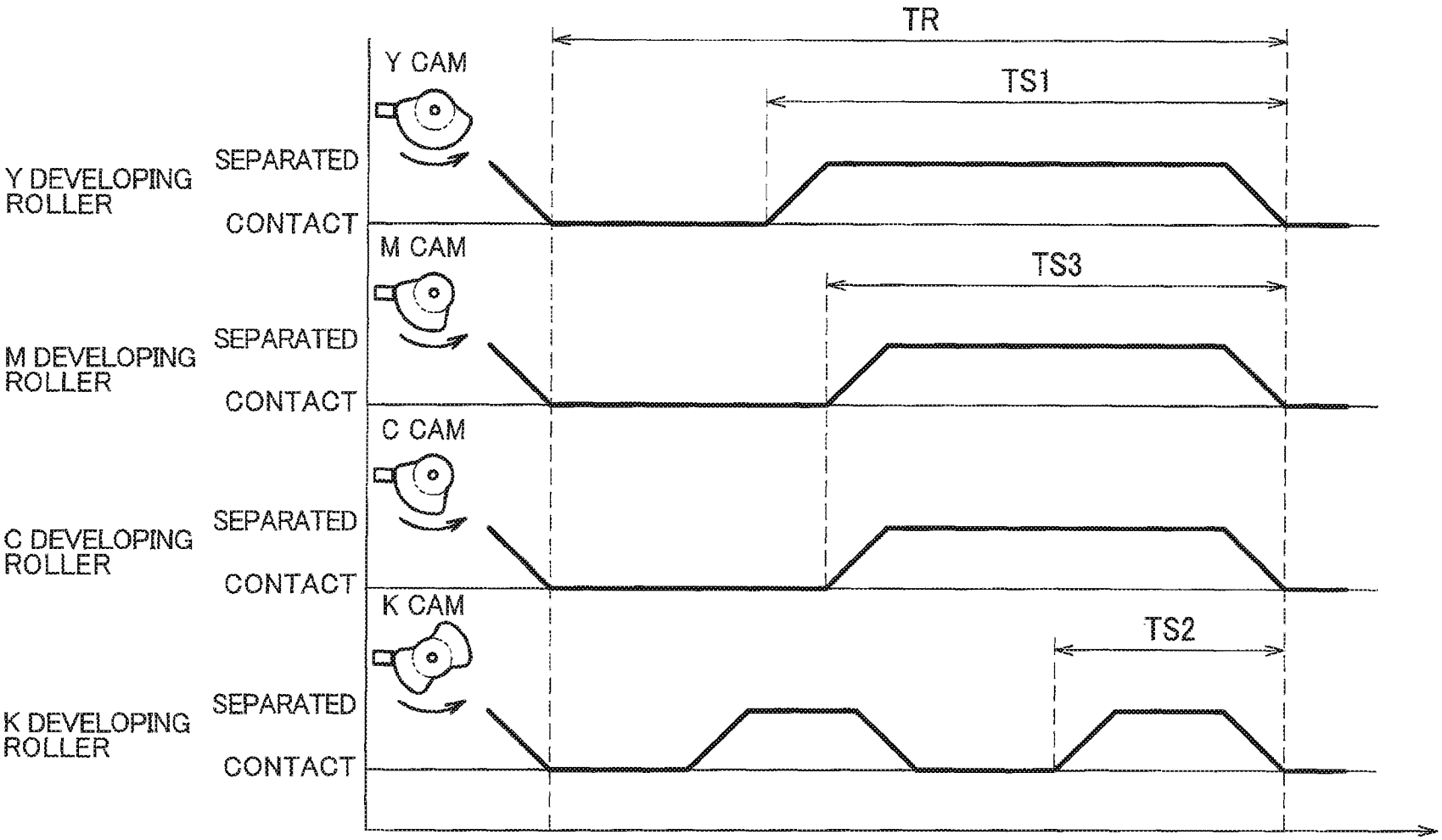
FIG. 3 is an explanatory diagram illustrating profiles of cams.

FIG. 3 illustrates a time period of each developing roller 61 at the separated position according to rotation of the corresponding cam 150. As explained later, the phase of the cams 150 are shifted each other. However, FIG. 3 is for comparing the time periods of the developing rollers 61, and thus does not take these shifts of phases into consideration. As illustrated in FIG. 3, a second separation time period TS2 of the K cam 150K is shorter than a first separation time period TS1 of the Y earn 150Y. The second separation time period TS2 of the K cam 150K is shorter than a third separation time period TS3 of the M cam 150M and the C cam 150C.

The first separation time TS1 refers to a period of time from when the Y developing roller 61Y at the contact position starts separating from the Y photosensitive drum 50Y to when the Y developing roller 61Y contacts the Y photosensitive drum 50Y again by the continuous rotation of the Y cam 150Y. The second separation time TS2 refers to a period of time from when the K developing roller 61K at the contact position starts separating from the K photosensitive drum 50K to when the K developing roller 61K contacts the K photosensitive drum 50K again by the continuous rotation of the K cam 150K. The third separation time TS3 refers to a period of time from when each of the M developing roller 61M and the C developing roller 61C at the contact position starts separating from the corresponding photosensitive drum 50 (50M or 50C) to when that developing roller 61 (61M or 61C) contacts the corresponding photosensitive drum OM or 50C) again by the continuous rotation of the corresponding cam (150M or 150C).

Referring back to FIG. 2, the image forming apparatus 1 includes a developing motor 3D, a process motor 3P, a fixing motor 3F, and a driving transmission mechanism 100, The driving transmission mechanism 100 transmits driving force of the developing motor 3D to the cams 150. The process motor 3P transmits driving force to the feeding mechanism 22, the plurality of photosensitive drums 50, and the driving roller 71. The fixing motor 3F transmits driving force to the heating roller 81.

The driving transmission mechanism 100 includes a first gear train 100A and a second gear train 100K, The first gear train 100A transmits the driving force of the developing motor 3D to the Y cam 150Y, the M cam 150M, and the C cam 150C. The second gear train 100K transmits the driving force of the developing motor 3D to the K cam 150K. The Y cam 150Y, the M cam 150M, and the C cam 150C are mechanically coupled to each other via gears and rotate simultaneously in response to the reception of the driving force.

A YMC clutch 140A is provided in the middle of the first gear train 100A and includes an electromagnetic clutch that switches between transmission and disconnection of the driving force in the first gear train 100A. In a transmission state, the YMC clutch 140A transmits the driving force from the developing motor 3D to the Y cam 150Y, the M cam 150M, and the C cam 1500. In a disconnection state, the YMC clutch 140A does not transmit the driving force to the Y earn 150Y, the M cam 150M, and the C cam 150C. A K clutch 140K is provided in the middle of the second gear train 100K and includes an electromagnetic clutch that switches between transmission and disconnection of the driving force the second gear train 100K. In a transmission state, the K clutch 140K transmits the driving force from the developing motor 3D to the K cam 150K. In a disconnection state, the K clutch 140K does not transmit the driving force to the K cam 150K. Hereinafter, "turning on the YMC clutch 140A" will refer to the operation of turning the YMC clutch.

140A into the transmission state, while "turning off the YMC clutch 140A" will refer to the operation of turning the YMC clutch 140A into the disconnection state. The same applies to the K clutch 140K.

Although not illustrated, in the present embodiment, the driving force is also transmitted to each developing roller 61 from the developing motor 3D, When the developing roller 61 is moving from the separated position to the contact position and has not contacted the corresponding photosensitive drum 50 yet, the developing roller 61 receives the driving force and starts rotating. When the developing roller 61 is moving from the contact position to the separated position and has been separated from the corresponding photosensitive drum 50, the developing roller 61 stops rotating with no driving force received. With this configuration, the developing roller 61 rotates at the contact position and does not rotate at the separated position. The developing roller 61 at the contact position receives the driving force even if the corresponding clutch 140 is turned off.

The Y cam 150Y, the M cam 150M, and the C earn 150C are disposed with the phases of the cam crests 152Y, 152M, and 152C shifted from each other by a predetermined angle. Specifically, the phases of upstream ends of the cam crests 152Y and 152M in the circumferential direction (counter clockwise direction) are the same. The phase of an upstream end of the cam crest 152C in the circumferential direction is shifted from those of the cam crests 152Y and 152M in the circumferential direction by the predetermined angle. The phases of downstream ends of the cam crests 152Y, 152M, and 152C in the circumferential direction are shifted from each other by the predetermined angles (for example, equal angles).

While the Y developing roller 61Y, the M developing roller 61M, and the C developing roller 61C are at the respective separated positions, the controller 2 turns on the YMC clutch 140A to transmit the driving three from the developing motor 3D to the Y cam 150Y, the M cam 150M, and the C cam 150C. This simultaneously rotates the Y cam 150Y, the M cam 150M, and the C cam 150G. In accordance with the conveyance of a sheet S, the Y cam 150Y starts moving the Y developing roller 61Y from the separated position to the contact position, and simultaneously the M cam 150M starts moving the M developing roller 61M from the separated position to the contact position. At a timing later than the Y developing roller 61Y and the M developing roller 61M, the C cam 150C starts moving the C developing roller 61C from the separated position to the contact position.

Specifically, while the Y developing roller 61Y, the M developing roller 61M, and the C developing roller 61C are at the separated positions, the Y cam 150Y, the M cam 150M, and the C cam 1500 are rotated simultaneously. First, the Y cam 150Y starts moving the Y developing roller 61Y toward the contact position. Subsequently, at a substantially simultaneous timing with the Y developing roller 61Y, the M cam 150M starts moving the NI developing roller 61M toward the contact position. At a timing later than the Y developing roller 61Y and the M developing roller 61M, the C cam 150C starts moving the C developing roller 61C toward the contact position. Thus, the Y developing roller 61Y and the M developing roller 61M substantially simultaneously reach the contact positions. After the Y developing roller 61Y and the M developing roller 61M reach the contact positions, the C developing roller 61C reaches the contact position. Subsequently, the controller 2 turns off the YMC clutch 140A to stop the developing rollers 61Y, 61M, and MC at the respective contact positions.

While the Y developing roller 61Y the M developing roller 61M, and the C developing roller 61C are at the contact positions with the YMC clutch 140A turned off, the controller 2 turns on the YMC clutch 140A to transmit the driving force to the Y cam 150Y, the M cam 150M, and the C cam 150C. Thus, the Y cam 150Y, the M cam 150M, and the C cam 150C rotate. Subsequently, in accordance with the conveyance of the sheet S, the Y cam 150Y, the M cam 150M, and the C cam 150C respectively start moving the Y developing roller 61Y, the M developing roller 61M, and the C developing roller 61C in this time order from the contact positions to the separated positions. Accordingly, the Y developing roller 61Y, the M developing roller 61M, and the C developing roller 61C reach the separated positions in this order.

The controller 2 turns on or off the K clutch 140K to control rotation of the K cam 150K independently of the Y cam 150Y, the M cam 150M, and the C cam 150C. When color printing is performed using the four developing rollers 61, the controller 2 controls the K cam 150K to rotate with the phase of the upstream end of the cam crest 132K shifted later than that of the C cam 150C by a predetermined angle.

Specifically, while the K developing roller 61K is at the separated position, the controller 2 turns on the K clutch 140K at a predetermined timing to transmit the driving force from the developing motor 3D to the K cam 150K. Thereafter, in accordance with the conveyance of a sheet S, the K cam 150K starts moving the K developing roller 61K from the separated position toward the contact position at a timing later than the C developing roller 61C. After the C developing roller 61C reaches the contact position, the K developing roller 61K reaches the contact position. Subsequently; the controller 2 turns off the K clutch 140K to stop the developing roller 61K at the contact position.

While the K developing roller 61K is at the contact position with the K clutch 140K turned off, the controller 2 turns on the K clutch 140K at a predetermined timing to transmit the driving force to the K cam 150K. Subsequently, in accordance with the conveyance of the sheet S, the K cam 150K starts moving the K developing roller 61K from the contact position to the separated position at a timing later than the C developing roller 61C. After the C developing roller 61C reaches the separated position, the K developing roller 61K reaches the separated position.

Figure 4A:
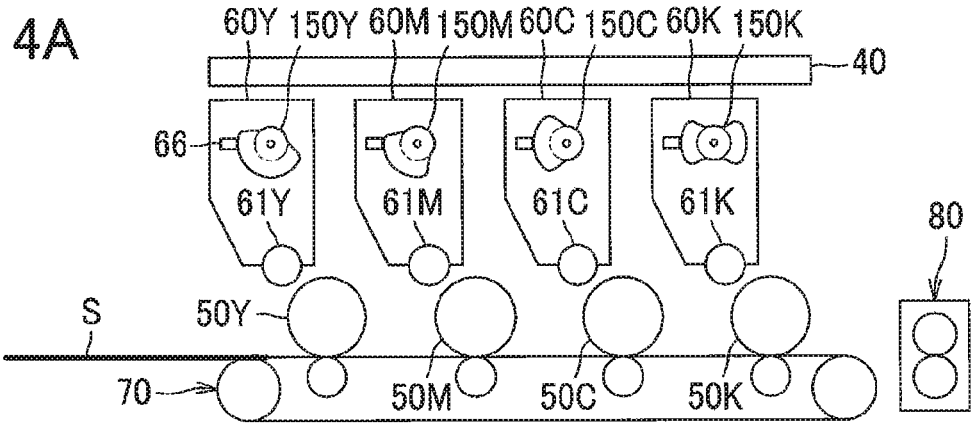
FIGS. 4A-4D are explanation diagrams illustrating first half of operations of the developing rollers when color printing is executed.

During color printing, the developing rollers 61 operate as follows. That is, as illustrated in FIG. 4A, before printing starts, the Y developing roller 61Y, the M developing roller 61M, the C developing roller 61C, and the K developing roller 61K are all at the separated positions.

Figure 4B:
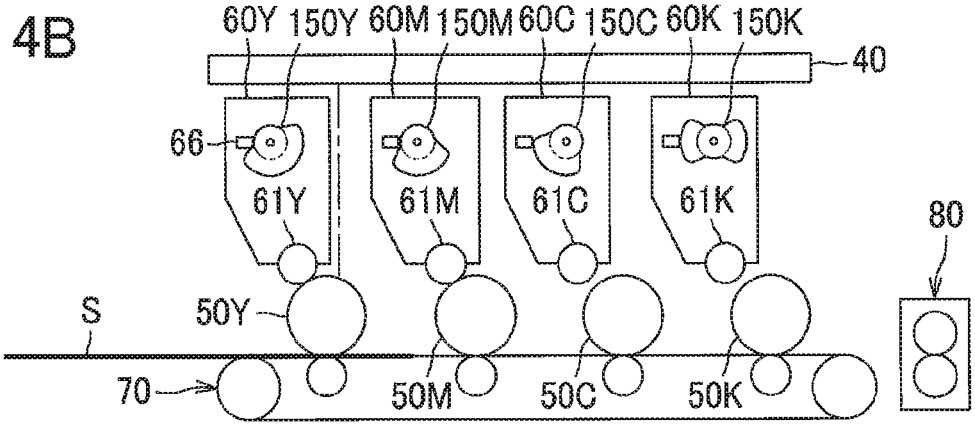

When a sheet S approaches the Y photosensitive drum 50Y, the Y cam 1501, the M cam. 150M, and the C cam 150C rotate. Before the exposure of the Y photosensitive drum 50Y, the Y earn 150Y and the M cam 150M substantially simultaneously move the Y developing cartridge 60Y and the M developing cartridge 60M so that the Y developing roller 61Y and the M developing roller 61M reach the contact positions respectively as illustrated in FIG. 4B. With the M developing roller 61M at the contact position, the M developing cartridge 60M does not overlap with the optical path of the light beam for exposing the Y photosensitive drum 50Y and allows the Y photosensitive drum 50Y to be exposed to the light beam. The Y developing roller 61Y starts development on the Y photosensitive drum 50Y to form a toner image thereon, and thereafter the toner image is transferred from the Y photosensitive drum 50Y to the sheet S.

Figure 4C:
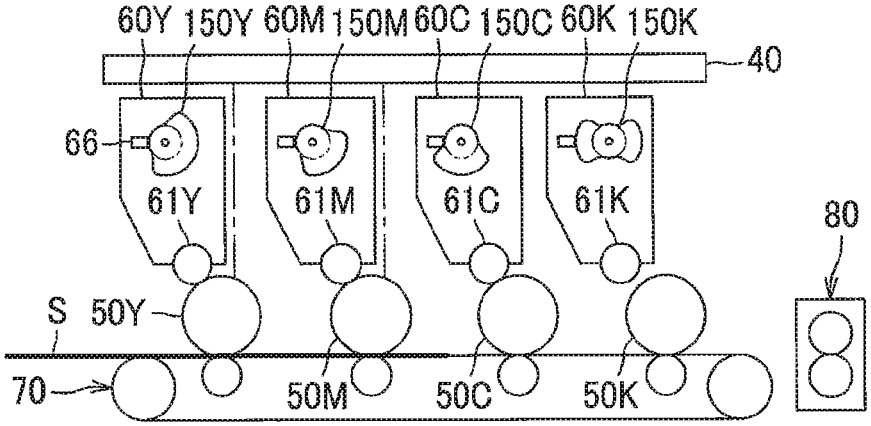

Next, the sheet S approaches the M photosensitive drum 50M. Before the exposure of the M photosensitive drum 50M, the C cam 150C moves the C developing cartridge 60C so that the C developing roller 61C reaches the contact position as illustrated in FIG. 4C. With the C developing roller 61C at the contact position, the C developing cartridge 60C does not overlap with the optical path of the light beam for exposing the M photosensitive drum 50M and allows the M photosensitive drum 50M to be exposed to the light beam. The M developing roller 61M starts development on the M photosensitive dram 50M to form a toner image thereon, and thereafter the toner image is transferred from the M photosensitive drum 50M to the sheet S.

Figure 4D:
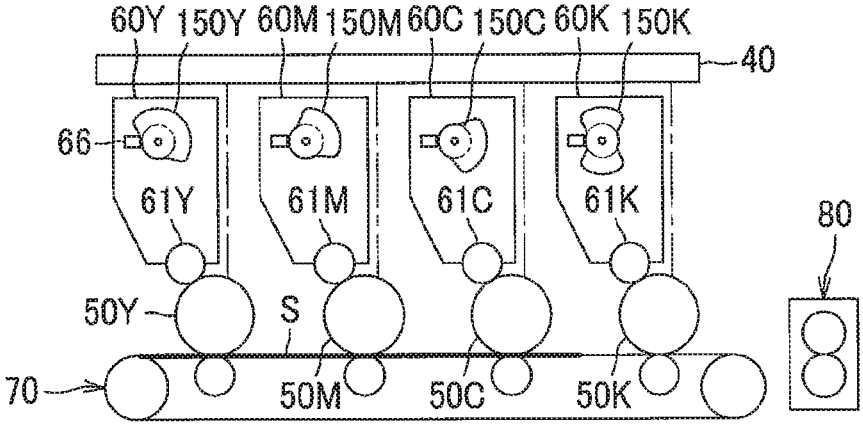

Next, the sheet S approaches the C photosensitive drum 50C. Before the exposure of the C photosensitive drum 50C, the K cam 150K rotates and moves the K developing cartridge 60K so that the K developing roller 61K reaches the contact position as illustrated in FIG. 4D. With the K developing roller 61K at the contact position, the K developing cartridge 60K does not overlap with the optical path of the light beam for exposing the C photosensitive drum 50C and allows the C photosensitive drum 50C to be exposed to the light beam. The C developing roller 61C starts development on the C photosensitive drum 50C to form a toner image thereon, and thereafter the toner image is transferred from the C photosensitive drum 50C to the sheet S. With the K developing roller 61K at the contact position, the K developing roller 61K starts development on the K photosensitive drum 50K to form a toner image thereon, and the toner image is transferred from the K photosensitive drum 50K to the sheet S.

Figure 5A:
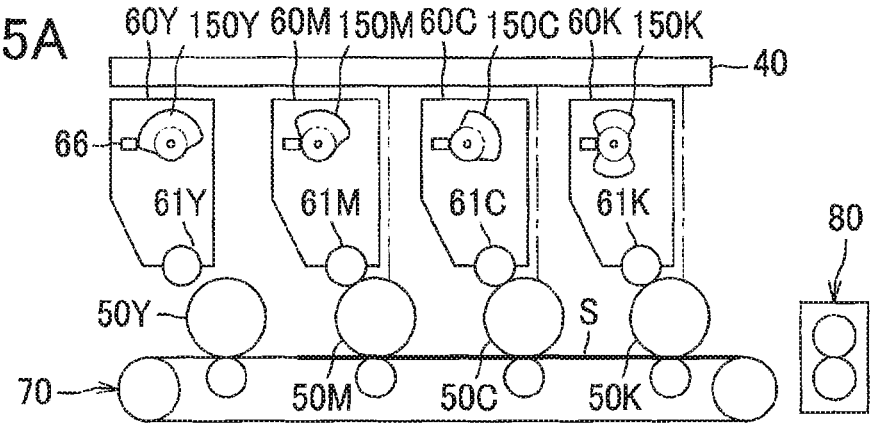
Figure 5B:
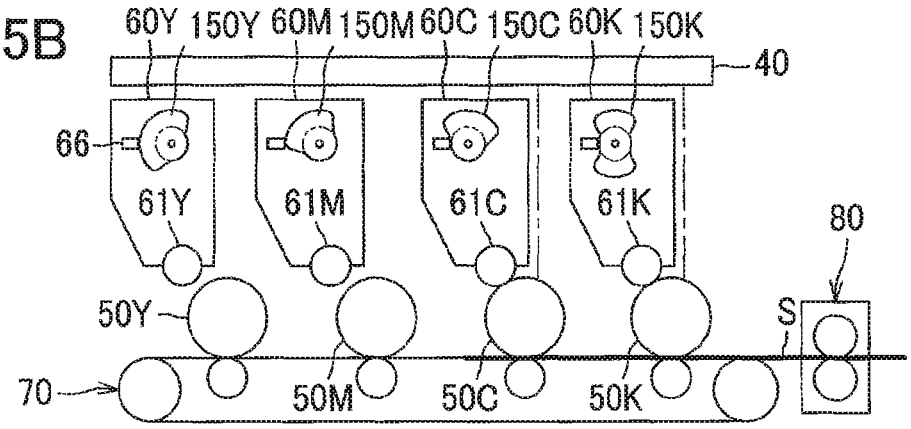

As illustrated in FIG. 5A, the Y cam 150Y, the M cam 150M, and the C cam 150C rotate again when the Y developing roller 61Y has finished the development on the Y photosensitive drum 50Y. Specifically, the Y cam 150Y moves the Y developing cartridge 60Y so that the Y developing roller 61Y reaches the separated position. Subsequently, as illustrated in FIG. 5B, when the M developing roller 61M has finished the development on the M photosensitive drum 50M, the M cam 150M moves the M developing cartridge 60M so that the M developing roller 61M reaches the separated position.

Figure 5C:
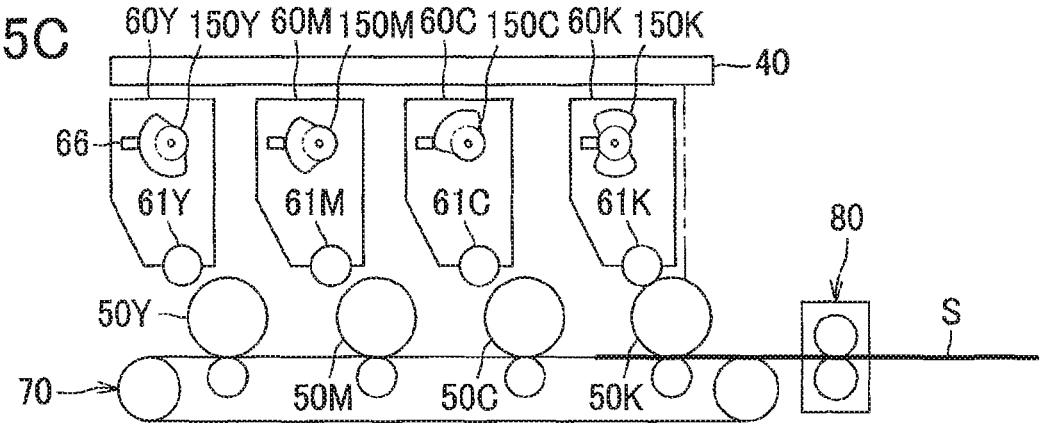
Figure 5D:
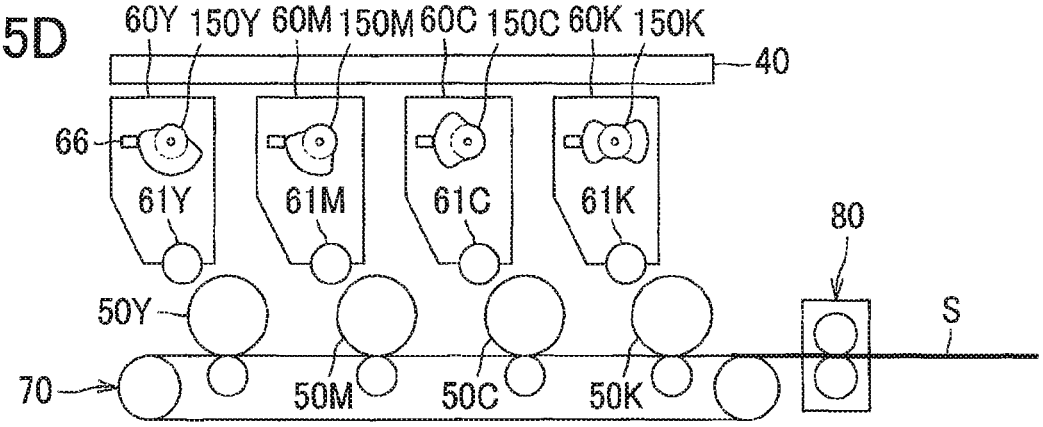

As illustrated in FIG. 5C, when the C developing roller 61C has finished the development on the C photosensitive drum 50C, the C cam 150C moves the C developing cartridge 60C so that the C developing roller 61C reaches the separated position. As illustrated in FIG. 5D, when the K developing roller 61K has finished the development on the K photosensitive drum 50K, the K cam 150K, which has already started rotating again, moves the K developing cartridge 60K so that the K developing roller 61K reaches the separated position.

In monochrome printing, an image is formed on a sheet S using only the K developing roller 61K. As illustrated in FIG. 6A, before monochrome printing starts, the Y developing roller 61Y, the M developing roller 61M, the C developing roller 61C, and the K developing roller 61K are all at the separated positions. When monochrome printing starts, the sheet S approaches the K photosensitive drum 50K. Before the exposure of the K photosensitive drum 50K, the K cam 150K rotates and moves the K developing cartridge 60K so that the K developing roller 61K reaches the contact position as illustrated in FIG. 6B. The K developing roller 61K starts development on the K photosensitive drum 50K to form a toner image thereon, and subsequently the toner image is transferred from the K photosensitive drum 50K, to the sheet S. As illustrated in FIG. 6C, after the K developing roller 61K has finished the development on the K photosensitive drum 50K, the K cam 150K, which has already started rotating again, moves the K developing cartridge 60K so that the K developing roller 61K reaches the separated position.

As illustrated in FIGS. 7A to 8B, the image forming apparatus 1 includes separation sensors 4C and 4K. As illustrated in FIGS. 7A and 7B, the separation sensor 4C is a phase sensor that detects the phases of the Y cam 150Y the M cam 150M, and the C cam 150C. When the Y cam 150Y, the M cam 150M, and the C cam 150C are within a predetermined phase range, the separation sensor 4C outputs a predetermined signal. When the Y cam 150Y, the M cam 150M, and the C cam 150C are out of the predetermined phase range, the separation sensor 4C does not output the predetermined signal. Specifically, the separation sensor 4C includes a light emitter 4P and a light receiver 4R. The light emitter 4P emits detection light. The light receiver 4R faces the light emitter 4P and receives the detection light from the light emitter 4P. A first detected portion 154A is disposed on the C cam 150C and protrudes in a direction parallel to a rotational axis of the C cam 150C.

The separation sensor 4C outputs the predetermined signal upon detection of the first detected portion 154A. Specifically, when the first detected portion 154A enters a space between the light emitter 4P and the light receiver 4R, the first detected portion 154A blocks detection light emitted from the light emitter 4P, and the light receiver 4R does not receive the detection light and the separation sensor 4C outputs the predetermined signal. When the first detected portion 154A moves out from the space between the light emitter 4P and the light receiver 4R, the light receiver 4R receives the detection light and the separation sensor 4C does not output the predetermined signal. While the separation sensor 4C directly detects the phase of the C cam 150C, the separation sensor 4C can indirectly detect the phases of the Y cam 150Y and the M cam 150M. Hereinafter, "the separation sensor 4C turns on" will refer to the operation of the separation sensor 4C outputting the predetermined signal, while "the separation sensor 4C turns off" will refer to the operation of the separation sensor 4C not outputting the predetermined signal. The same applies to the separation sensor 4K. Voltage of signals when the separation sensor 4C turns on may be higher than the voltage of signals when the separation sensor 4C turns off. Contrarily, voltage of signals when the separation sensor 4C turns on may be lower than the voltage of signals when the separation sensor 4C turns off.

As illustrated in FIGS. 8A and 8B, the separation sensor 4K detects the phase of the K cam 150K and includes the light emitter 4P and the light receiver 4R. Two second detected portions 154K are disposed on the K cam 150K and protrude in a direction parallel to the rotational axis of the K developing roller 61K. When one of the second detected portions 154K enters a space between the light emitter 4P and the light receiver 4R, the detected portion 154K blocks detection light emitted from the light emitter 4P, and the light receiver 4R does not receive the detection light and the separation sensor 4K turns on. When the second detected portion 154K moves out from the space between the light emitter 4P and the light receiver 4R, the light receiver 4R receives the detection light and the separation sensor 4K turns off.

The first detected portion 154A is positioned so as to be detected by the separation sensor 4C and the separation sensor 4C turns on when the C developing roller 61C has moved from the contact position to the separated position. If the C cam 150C continues rotating so that the first detected portion 154A moves out from the space between the light emitter 4P, the light receiver 4R and the separation sensor 4C turns off, but the C developing roller 61C is stayed at the separated position for a while, and thereafter the C developing roller 61C starts moving toward the contact position. The two second detected portions 154K are disposed at different positions so as to be detected by the separation sensor 4K and the separation sensor 4K turns on when the K developing roller 61K has moved from the contact position to the separated position. If the K cam 150K continues rotating so that the second detected portion 154K moves out from the space between the light emitter 4P and the light receiver 4R, the separation sensor 4K turns off, but the K developing roller 61K is stayed at the separated position for a while, and thereafter the K developing roller 61K starts moving toward the contact position. Although not illustrated, since the M cam 150M is the same configuration as the C cam 150C, the M cam 150M has a portion having a similar shape to the first detected portion 154A. However, this portion does not function as a detected portion because no separation sensor is provided for the M cam 150M.

The controller 2 controls the operation of the image forming apparatus 1 and performs each process by executing a program stored in advance The controller 2 includes, a central processing unit (CPU) 31, and a storage 32 having a read-only memory (ROM) and a random access memory (RAM), and an input/output portion (not shown). In the present embodiment, the controller 2 controls the YMC clutch 140A and the K clutch 140K based on signals received from the first pre-registration sensor 28B, the post-registration sensor 28C, and the separation sensors 4C and 4K to control the developing rollers 61 to be in contact with or be separated from the respective photosensitive drums 50.

The controller 2 can perform color printing and monochrome printing. In color printing, the controller 2 uses the Y developing roller 61Y, the M developing roller 61M, the C developing roller 61C, and the K developing roller 61K to form an image on a sheet S. In monochrome printing, the controller 2 uses only the K developing roller 61K among the four developing rollers 61 to form an image on a sheet S.

When performing color printing using a sheet S in the internal tray 21, the controller 2 controls the feed roller 23 to pick up a sheet S in the internal tray 21. Next, the controller 2 controls the first moving mechanism 5A to start moving the Y developing roller 61Y, the M developing roller 61M, and the C developing roller 61C from the separated positions to the contact positions. Subsequently, the controller 2 controls the second moving mechanism 5K to start moving the K developing roller 61K from the separated position to the contact position.

Specifically, after receiving a print job, the image forming apparatus 1 prepares for printing. For example, the image forming apparatus 1 generates image data of an image to be printed on the sheet S, that is, processes image data included in the print job to generate image data in a raster format. Upon completion of the preparation, that is, when a fourth time period has elapsed since the reception of the print job, the controller 2 rotates the feed roller 23 to pick up a sheet S in the internal tray 21.

The "fourth time period" (and "first time period" described later) may be a fixed or variable value. In the present embodiment, the first time period and the fourth time period correspond to a period of time until the image forming apparatus 1 completes the preparation for printing. Thus, the first time period and the fourth time period vary depending on the size of the image data or the processing speed of rasterization of the image data, for example.

When a fifth time period T11 has elapsed since the controller 2 determined based on signals from the first registration sensor 28B that a leading end of the sheet S passes the first pre-registration sensor 28B, the controller 2 turns on the YMC clutch 140A to drive the first moving mechanism 5A. Accordingly, the Y cam 150Y, the M cam 150M, and the C cam 150C rotates, and the Y developing roller 61Y, the M developing roller 61M, and the C developing roller 61C start moving from the respective separated positions to the respective contact positions. When a third time period T21 has elapsed since the controller 2 determined based on signals from the post-registration sensor 28C that the leading end of the sheet S passes the post-registration sensor 28C, the controller 2 turns on the K clutch 140K to drive the second moving mechanism 5K. Accordingly, the K cam 150K rotates, and the K developing roller 61K starts moving from the separated position to the contact position.

When performing monochrome printing using a sheet S in the internal tray 21, the controller 2 controls the feed roller 23 to pick up a sheet Sin the internal tray 21. Next, the controller 2 controls the second moving mechanism 5K to start moving the K developing roller 61K from the separated position to the contact position.

Specifically, after receiving a print job, the image forming apparatus 1 prepares for printing. Upon completion of the preparation, the controller 2 rotates the feed roller 23 to pick up a sheet S in the internal tray 21. When a third time period T21 has elapsed since the controller 2 determined based on signals from the post-registration sensor 28C that a leading end of the sheet S passes the post-registration sensor 28C, the controller 2 turns on the K clutch 140K. Accordingly, the K cam 150K rotates, and the K developing roller 61K starts moving from the separated position to the contact position.

When performing color printing using a sheet S on the manual feed tray 41, the controller 2 controls the first moving mechanism 5A to start moving the Y developing roller 61Y, the M developing roller 61M, and the C developing roller 61C from the separated positions to the contact positions. The controller 2 then controls the manual feed roller 43 to pick up a sheet S on the manual feed tray 41. Subsequently, the controller 2 controls the second moving mechanism 5K to start moving the K developing roller 61K from the separated position to the contact position.

Specifically, after receiving the print job, the image forming apparatus 1 prepares for printing. For example, the image forming apparatus 1 generates image data of an image to be printed on the sheet S. Upon completion of the preparation, that is, when the first time period has elapsed since the controller 2 received the print job, the controller 2 drives the first moving mechanism 5A, that is, turns on the YMC clutch 140A. Accordingly, the first moving mechanism 5A rotates the Y cam 150Y, the M cam 150M, and the C cam 150C.

When a second tune period T10 has elapsed since the YMC clutch 140A was turned on, that is, since the Y cam 150Y, the M cam 150M, and the C cam 150C started moving, the controller 2 rotates the manual feed roller 43 to pick up a sheet S on the manual feed tray 41. When a third time period T21 has elapsed since the controller 2 determined based on signals from the post-registration sensor 28C that a leading end of the sheet S passes the post-registration sensor 28C, the controller 2 turns on the K clutch 140K. Accordingly, the K cam 150K rotates, and the K developing roller 61K starts moving from the separated position to the contact position.

When performing monochrome printing using a sheet S on the manual feed tray 41, the controller 2 controls the manual feed roller 43 to pick up a sheet S on the manual feed tray 41. Subsequently, the controller 2 controls the second moving mechanism 5K to start moving the K developing roller 61K from the separated position to the contact position.

Specifically, after receiving a print job, the image forming apparatus 1 prepares for printing. Upon completion of the preparation, the controller 2 rotates the manual feed roller 43 to pick up a sheet S on the manual feed tray 41. When a third time period T21 has elapsed since the controller 2 determined based on signals from the post-registration sensor 28C that a leading end of the sheet S passes the post-registration sensor 28C, the controller 2 turns on the K clutch 140K. Accordingly, the K cam 150K rotates, and the K developing roller 61K starts moving from the separated position to the contact position.

An example of a process performed by the controller 2 will be described with reference to FIGS. 9 to 16. As illustrated in FIG. 9, in S11, upon receiving a print job, the controller 2 determines whether an image forming instruction in the print job indicates color printing. When the image forming instruction indicates color printing (S11: Yes), in S12 the controller 2 determines based on the print job whether to supply a sheet S from the manual feed tray 41. When a sheet S is to be supplied from the manual feed tray 41 (S12: Yes), in S13 the controller 2 performs a process for manual-feed color printing. The manual-feed color printing refers to color printing using a sheet S on the manual feed tray 41. When a sheet S is to be supplied from the internal tray 21 (S12: No), in S14 the controller 2 performs a process for normal-feed color printing. The normal-feed color printing refers to color printing using a sheet S in the internal tray 21.

When the image forming instruction indicates monochrome printing (S11: No), in S15 the controller 2 performs a process for monochrome printing. Upon completion of one of the printing processes S13-S15, in S16 the controller 2 determines whether the print job includes an image forming instruction for the next page. When the print job includes the image forming instruction for the next page (S16: Yes), the controller 2 repeats the processes from step S11. When the print job does not include the image forming instruction for the next page (S16: No), the controller 2 ends the process.

Next, the process for the normal-feed color printing (S14) will be described with reference to FIGS. 10 and 11. In a topmost section of FIG. 11, operations of the Y developing roller 61Y, the M developing roller 61M, and the C developing roller 61C are denoted with different types of lines on a "YMC developing roller" timing chart. Likewise, a light beam for exposing the Y photosensitive drum 50Y, a light beam for exposing the M photosensitive drum 50M, a light beam for exposing the C photosensitive drum 50C, and a light beam for exposing the K photosensitive drum 50K are denoted with different types of lines on a "exposure" timing chart to illustrate respective timings to turn on or off each light beam.

Before the normal-feed color printing starts, all the developing rollers 61 are at the separated positions. When the normal-feed color printing starts, in S101 (t30) the controller 2 turns on the YMC clutch 140A and the K clutch 140K to rotate all the earns 150. When each of the separation sensors 4C and 4K turn off by the rotation of the C cam. 150C and the K cam 150K (S102: Yes), in S103 (t31) the controller 2 turns off the YMC clutch 140A and the K clutch 140K to stop the cams 150. The controller 2 may turn off the YMC clutch 140A immediately after the separation sensor 4C turns off, and turn off the K clutch 140K immediately after the separation sensor 4K turns off. Through this operation, the cams 150 are rotated to predetermined phases so that the developing rollers 61 are positioned at the respective separated positions and can be moved toward the respective contact positions later.

In S111, the controller 2 determines whether the preparation for printing is completed. When the preparation for printing is completed (S111: Yes), in S112 (t32) the controller 2 rotates the feed roller 23 to pick up a sheet S from the internal tray 21. Hereinafter, "turning on the feed roller 23" will refer to the operation of rotating the feed roller 23.

In S113, the controller 2 determines whether the fifth time period T11 has elapsed since the controller 2 determined based on signals from the first pre-registration sensor 28B that a leading end of the sheet S passes the first pre-registration sensor 28B, that is, since the first pre-registration sensor 28B turned on (t33). When the fifth time period T11 has elapsed (S113: Yes), in S114 (t34) the controller 2 turns on the YMC clutch 140A. Accordingly, the Y cam 150Y, the M cam 150M, and the C cam 150C rotate so that the Y developing roller 61Y, the M developing roller 61M, and the C developing roller 61C start moving toward the respective contact positions at respective timings. The fifth time period T11 is set such that a toner image on the Y photosensitive drum 50Y developed by the Y developing roller Y can be timely transferred to the conveyed sheet S if the YMC clutch 140A is turned on when the fifth time period T11 has elapsed since the first pre-registration sensor 28B turned on.

In S131, the controller 2 determines whether the third time period T21 has elapsed since the controller 2 determined based on signals from the post-registration sensor 28C that a leading end of the sheet S passes the post-registration sensor 28C, that is, since the post-registration sensor 28C turned on (t35). When the third time period T21 has elapsed (S131 Yes), in S132 (t36) the controller 2 turns on the K clutch 140K. Accordingly, the K clutch 140K rotate the K cam 150K so that the K developing roller 61K starts moving toward the contact position. The third time period T21 is set such that a toner image on the K photosensitive drum 50K developed by the K developing roller 61K can be timely transferred to the conveyed sheet S if the K clutch 140K is turned on when the third time period 121 has elapsed since the post-registration sensor 28C turned on.

In S141, the controller 2 determines whether a predetermined time period T12 has elapsed since the YMC clutch 140A was turned on (t34). When the predetermined time period T12 has elapsed (S141: Yes), in S142 (t37) the controller 2 turns off the YMC clutch 140A to stop the Y cam 150Y, the M cam 150M, and the C cam 150C. The predetermined time period T12 is set such that the Y developing roller 61Y, the M developing roller 61M, and the C developing roller 61C are all at the contact positions after the predetermined time period T12 has elapsed since the YMC clutch 140A was turned on. In S143, the controller 2 determines whether a predetermined time period T22 has elapsed since the K clutch 140K was turned on (t36). When the predetermined time period T22 has elapsed (S143: Yes), in S144 (t38) the controller 2 turns off the K clutch 140K to stop the K cam 150K. The predetermined time period T22 is set such that the K developing roller 61K is at the contact position after the predetermined time period T22 has elapsed since the K clutch 140K was turned on.

When a predetermined time period TE1 has elapsed since the post-registration sensor 28C turned on (t35), the controller 2 controls the exposure device 40 to sequentially emit light beams to the Y photosensitive drum 50Y, the M photosensitive drum 50M, the C photosensitive drum 50C, and the K photosensitive drum 50K in this order for exposure. The Y developing roller 61Y and the M developing roller 61M reach the contact positions substantially simultaneously with the start of the exposure of the Y photosensitive drum 50Y. The C developing roller 61C reaches the contact position substantially simultaneously with the start of the exposure of the M photosensitive drum 50M The K developing roller 61K reaches the contact position substantially simultaneously with the start of the exposure of the C photosensitive drum 50C (t91). Accordingly, when an electrostatic latent image is formed on each of the photosensitive drums 50Y, 50M, 50C, and 50K, a tonner can be supplied to the electrostatic latent image from corresponding one of the developing rollers 61Y, 61M, 61C, and 61K to form a toner image, and the toner image can be transferred to the sheet S.

In S151, the controller 2 determines whether a predetermined time period T13 has elapsed since the controller 2 determined based on signals from the post-registration sensor 28C that a trailing end of the sheet S passes the post-registration sensor 28C, that is, since the post-registration sensor 28C turned off (t39). When the predetermined time period T13 has elapsed (S151: Yes), in S152 (t40) the controller 2 turns on the YMC clutch 140A. Accordingly, the Y cam 150Y, the M cam 150M, and the C cam 150C rotate so that the Y developing roller 61Y, the M developing roller 61M, and the C developing roller 61C start moving toward the separated positions. The predetermined time period T13 is set such that the Y developing roller 61Y is positioned at the separated position immediately after transfer of the toner image from the Y photosensitive drum 50Y to the sheet S is completed subsequently to completion of the toner image developed on the Y photosensitive drum 50Y by the Y developing roller 61Y.

In S153, the controller 2 determines whether a predetermined time period T23 has elapsed since the post-registration sensor 28C turned off (t39). When the predetermined time period T23 has elapsed (S153: Yes), in S154 (t41) the controller 2 turns on the K clutch 140K. Accordingly, the K cam 150K rotates, and the K developing roller 61K starts moving to the separated position. The predetermined time period T23 is specified such that the K developing roller 61K is positioned at the separated position immediately after transfer of the toner image from the K photosensitive drum 50K to the sheet S is completed subsequently to completion of the toner image developed on the K photosensitive drum 50K.

When a predetermined time period TE2 has elapsed since the post-registration sensor 28C turned off (t39), the controller 2 controls the exposure device 40 to sequentially stop emitting the light beams to the Y photosensitive drum 50Y, the M photosensitive drum 50M, the C photosensitive drum 50C, and the K photosensitive drum 50K in this order for exposure. The Y developing roller 61Y starts moving to the separated position substantially simultaneously with the completion of the exposure of the Y photosensitive drum 50Y. The M developing roller 61M starts moving to the separated position substantially simultaneously with the completion of the exposure of the M photosensitive drum 50M. The C developing roller 61C starts moving to the separated position substantially simultaneously with the completion of the exposure of the C photosensitive drum 50C. The K developing roller 61K starts moving to the separated position substantially simultaneously with the completion of the exposure of the K photosensitive drum 50K.

In S161, the controller 2 determines whether the separation sensor 4C has turned on. When the separation sensor 4C has turned on (S161: Yes), in S162 (t42) the controller 2 turns off the YMC clutch 140A to stop the Y earn 150Y, the M cam 150M, and the C cam 150C. In S163, the controller 2 determines whether the separation sensor 4K has turned on. When the separation sensor 4K has turned on (S163: Yes), in S164 (t43) the controller 2 turns off the K clutch 140K to stop the K cam 150K.

Next, the process for the monochrome printing (S15) will be described with reference to FIGS. 12 and 13. This monochrome printing uses a sheet S in the internal tray 21. During the monochrome printing, the controller 2 does not turn on the YMC clutch 140A and keeps the Y developing roller 61Y, the M developing roller 61M, and the C developing roller 61C at the separated positions.

When the monochrome printing starts, in S201 (t30) the controller 2 turns on the K clutch 140K to rotate the K earn 150K. In S202 the controller 2 waits until the separation sensor 4K turns off. When the separation sensor 4K turns off by the rotation of the K cam 150K (S202: Yes), in S203 (t31) the controller 2 turns off the K clutch 140K to stop the K cam 150K so that the K developing roller 61K is at the separated position.

In S211, the controller 2 determines whether the preparation for printing is completed. When the preparation for printing is completed (S211: Yes), in S212 (t32) the controller 2 turns on the feed roller 23 to pick up a sheet S from the internal tray 21. In S231, the controller 2 determines whether a third time period T21 has elapsed since the post-registration sensor 28C turned on (t35). When the third time period T21 has elapsed (S231: Yes), in S232 (t46) the controller 2 turns on the K clutch 140K. Accordingly, the K cam 150K rotates so that the K developing roller 61K starts moving toward the contact position. In S241, the controller 2 determines whether the predetermined time period T22 has elapsed since the K clutch 140K was turned on. When the predetermined time period T22 has elapsed (S241: Yes), in S242 (t48) the controller 2 turns off the K clutch 140K to stop the K earn 150K. Accordingly, when an electrostatic latent image is formed on the K photosensitive drum 50K, a Conner can be supplied to the electrostatic latent image from the K developing roller 61K to form a toner image, and the toner image can be transferred to the sheet S.

When a predetermined time period TE1 has elapsed since the post-registration sensor 28C turned on (135), the controller 2 controls the exposure device 40 to emit a light beam to the K photosensitive drum 50K for exposure. The predetermined time period. TE1 and the third time period T21 in monochrome printing are different from the predetermined time period TE1 and the third time period T21 in color printing. In monochrome printing, the third time period T21 is set such that the K developing roller 61K is positioned at the contact position substantially simultaneously with the start of the exposure of the K photosensitive drum 50K and a toner image on the K photosensitive drum 50K developed by the K developing roller 61K can be timely transferred to the conveyed sheet S if the K clutch 140K is turned on when the third time period T21 has elapsed since the post-registration sensor 28C turned on.

In the normal-feed color printing (see t91 in FIG. 11), the K developing roller 61K reaches the contact position substantially simultaneously with the start of the exposure of the C photosensitive drain 50C. In the monochrome printing (see t92 in FIG. 13), the K developing roller 61K reaches the contact position at a later timing than that of the normal-feed color printing, that is, substantially simultaneously with the start of the exposure of the K photosensitive drum 50K. This configuration can reduce the contact time between the K developing roller 61K and the K photosensitive drum 50K during image formation on the sheet S.

In S251, the controller 2 determines whether the predetermined time period T23 has elapsed since the post-registration sensor 28C turned off (t39). When the predetermined time period T23 has elapsed (S251: Yes), in S252 (t41) the controller 2 turns on the K clutch 140K. Accordingly, the K cam 150K rotates so that the K developing roller 61K starts moving toward the separated position.

When a predetermined time period TE2 has elapsed since the post-registration sensor 28C turned off (t39), the controller 2 causes the exposure device 40 to stop emitting the light beam to the K photosensitive drum 50K for exposure. The K developing roller 61K starts moving to the separated position substantially simultaneously with the completion of the exposure of the K photosensitive drum 50K. The predetermined time period TE2 in the monochrome printing is different from the predetermined time period T2 in the normal-feed color printing.

In S261, the controller 2 determines whether the separation sensor 4K has turned on. When the separation sensor 4K has turned on (S261: Yes), in S262 (t43) the controller 2 turns off the K clutch 140K to stop the K cam 150K.

Next, the process for the manual-feed color printing (S13) will be described with reference to FIGS. 14 and 15. In the normal-feed color printing, before the YMC clutch 140A is turned on, a sheet S is picked up. In the manual-feed color printing, after the YMC clutch 140A is turned on, a sheet S is picked up. The following description will omit description of processes similar to the ones described above and focus on different processes.

When the manual-feed color printing starts, in S101 to S103 the controller 2 rotates the cams 150 to the predetermined phases so that the developing rollers 61 can be moved toward the contact positions later.

In S111, the controller 2 determines whether the preparation for printing is completed. When the preparation for printing is completed (S111: Yes), in S114 (t32) the controller 2 turns on the YMC clutch 140A. Accordingly, the Y earn 150Y, the M cam 150M, and the C cam 150C rotate so that the Y developing roller 61Y, the M developing roller 61M, and the C developing roller 61C start moving toward the contact positions. In S121, the controller 2 determines whether the second time period T10 has elapsed since the YMC clutch 140A was turned on (t32). When the second time period T10 has elapsed (S121: Yes), in S122 (152) the controller 2 turns on the manual feed roller 43 to pick up a sheet S from the manual feed tray 41. The second time period T10 is set such that a toner image on the Y photosensitive drum 50Y developed by the Y developing roller Y can be timely transferred to the sheet S conveyed from the manual feed tray 41 if the manual feed roller 43 is turned on when the second time period T10 has elapsed since the YMC clutch 140A was turned on.

When the third time period T21 has elapsed since the post-registration sensor 28C turned on by the passage of a leading end of the sheet S (t55) (S131: Yes), in S132 (t56) the controller 2 turns on the K clutch 140K and starts moving the K developing roller 61K to the contact position. The third time period T21 and a predetermined time period TE1 in the manual-feed color printing are different from the third time period 121 and the predetermined time period TE1 in the normal-feed color printing.

When the predetermined time period T12 has elapsed since the YMC clutch 140A was turned on (S141: Yes), in S142 (t57) the controller 2 turns off the YMC clutch 140A to stop the Y cam 150Y, the M cam 150M, and the C cam 150C. When the predetermined time period T22 has elapsed since the K clutch 140K was turned on (S143: Yes), in S144 (t58) the controller 2 turns off the K clutch 140K to stop the K cam 150K. Accordingly, when an electrostatic latent image is formed on each of the photosensitive drums 50Y, 50M, 50C, and 50K, a tonner can be supplied to the electrostatic latent image from corresponding one of the developing rollers 61Y, 61M, 61C, and 61K to form a toner image, and the toner image can be transferred to the sheet S.

When the predetermined time period T13 has elapsed since the post-registration sensor 28C turned off (t59) (S151: Yes), in S152 (t60) the controller 2 turns on the YMC clutch 140A so that the Y developing roller 61Y, the M developing roller 61M, and the C developing roller 61C start moving toward the separated positions. When the predetermined time period T23 has elapsed since the post-registration sensor 28C turned off (t59) (S153: Yes), in S154 (t61) the controller 2 turns on the K clutch 140K so that the K developing roller 61K starts moving toward the separated position.

When the separation sensor 4C has turned on (S161: Yes), in S162 (t62) the controller 2 turns off the YMC clutch 140A to stop the Y cam 50Y, the M cam 150M, and the C cam 150C. When the separation sensor 4K has turned on (S163: Yes), in S164 (t63) the controller 2 turns off the K clutch 140K to stop the K cam 150K.

Next, a process for monochrome printing will be described with reference to FIGS. 12 and 16, This monochrome printing uses a sheet S on the manual feed tray 41. This monochrome printing using a sheet S on the manual feed tray may be executed instead of the monochrome printing using a sheet S in the internal tray 21 explained above with reference to FIGS. 12 and 13. However, similarly to S12, the controller 2 may execute a step to determine from the print job whether to supply a sheet S from the manual feed tray 41. In this case, the monochrome printing using a sheet S on the manual feed tray or the monochrome printing using a sheet S in the internal tray 21 may be executed based on this determination.

When the monochrome printing starts, the controller performs processes in steps S201 to S203.

In S211, the controller 2 determines whether the preparation for printing is completed. When the preparation for printing is completed (S211: Yes), in S212 (t72) the controller 2 turns on the manual feed roller 43 to pick up a sheet S from the manual feed tray 41. In S231, the controller 2 determines whether the third time period T21 has elapsed since the post-registration sensor 28C turned on (t75). When the third time period T21 has elapsed (S231: Yes), in S232 (t76) the controller 2 turns on the K clutch 140K. Accordingly, the K cam 150K rotates so that the K developing roller 61K starts moving toward the contact position. The third time period T21 in the monochrome printing using a sheet S on the manual feed tray 41 is different from the third time period T21 in the monochrome printing using a sheet S in the internal tray 21.

When the predetermined time period T22 has elapsed since the K clutch 140K was turned on (S241: Yes), in S242 (t78) the controller 2 turns off the K clutch 140K to stop the K cam 150K. Accordingly, when an electrostatic latent image is formed on the K photosensitive drum 50K, a tonner can be supplied to the electrostatic latent image from the K developing roller 61 Kto form a toner image, and the toner image can be transferred to the sheet S. A predetermined time period TE1 in the monochrome printing using a sheet S on the manual feed tray 41 is different from the predetermined time period TE1 in the monochrome printing using a sheet S in the internal tray 21.

When the predetermined time period T23 has elapsed since the post-registration sensor 28C turned off (t79) (S251: Yes), in S252 (t81) the controller 2 turns on the K clutch 140K so that the K developing roller 61K starts moving toward the separated position. When the separation sensor 4K has camed on (S261: Yes), in S262 (t83) the controller 2 turns off the K clutch 140K to stop the K cam 150K.

Technical advantages of the image forming apparatus 1 according to the embodiment will be described. In the manual-feed color printing, since the distance between the manual feed tray 41 and the Y photosensitive drum 50Y along the conveyance path is small, the image forming apparatus 1 starts moving the Y developing roller 61Y to the contact position before picking up a sheet S from the manual feed tray 41. According to this configuration, the Y developing roller 61Y can contact the Y photosensitive drum 50Y sufficiently before the sheet S, which is fed after start of the Y developing roller 61Y reaches the Y photosensitive drum 50Y. Further, the contact time between the developing rollers 61 and the photosensitive drums 50 for image formation on the sheet S can be reduced, compared to a conceivable configuration where the sheet S is picked up after all the developing rollers 61 contact the respective photosensitive drums 50.

In the normal-feed color printing, since the distance between the internal tray 21 and the Y photosensitive drum 50Y along the conveyance path is large, the image forming apparatus 1 starts moving the Y developing roller 61Y to the contact position after picking up a sheet S from the internal tray 21. Accordingly, similarly to the case of the manual-feed color printing, the contact time between the Y developing roller 61Y and the Y photosensitive drum 50Y for image formation on the sheet S can be reduced, compared to a conceivable configuration where the image forming apparatus 1 starts moving the Y developing roller 61Y to the contact position at an earlier timing.

In accordance with the conveyance of a sheet S, the image forming apparatus 1 substantially simultaneously moves the Y developing roller 61Y and the M developing roller 61M from the separated positions to the contact positions and then moves the C developing roller 61C from the separated position to the contact position. After that, the image forming apparatus 1 moves the Y developing roller 61Y, the M developing roller 61M, and the C developing roller 61C from the contact positions to the separated positions in this order. This configuration can reduce the contact time between the Y developing roller 61Y, M developing roller 61M, and C developing roller 61C and the respective Y photosensitive drum 50Y, M photosensitive drum 50M, and C photosensitive drum 50C for image formation on the sheet S, compared to a conceivable configuration where the image forming apparatus 1 simultaneously starts moving the Y developing roller 611; the M developing roller 61M, and the C developing roller 61C from the separated positions to the contact positions or from the contact positions to the separated positions.

The image forming apparatus 1 includes the separation sensor 4C to detect the phases of the Y cam 150Y, the M cam 150M, and the C cam 150C. When the Y cam 150Y the M cam 150M, and the C cam 150C are within the predetermined phase range, the separation sensor 4C turns on. When the Y cam 150Y the t11 cam 150M, and the C cam 150C are out of the predetermined phase range, the separation sensor 4C turns off. With this configuration, the image forming apparatus 1 can control the Y cam 150Y, the M cam 150M, and the C cam 150C with improved accuracy since the image forming apparatus 1 controls the Y cam 150Y, the M cam 150M, and the C cam 150C based on the phase range during which the separation sensor 4C turns on. Moreover, since the separation sensor 4C is provided on the C earn 150C and turns on upon detection of the first detected portion 154A and a relation of phases of the Y cam 150Y, the M cam 150M, and the C cam 150C is predetermined, the separation sensor 4C does not need to be provided on each earn 150. This configuration can minimize the number of separation sensors required in the image forming apparatus 1.

While the disclosure has been described in detail with reference to the specific embodiment thereof, it would be apparent to those skilled in the art that various changes and modifications may be made therein without departing from the scope of the invention. For example, while the post-registration sensor 28C is exemplified as the first sheet sensor in the above embodiment, the first sheet sensor may be any sensor that can detect the passage of a sheet S. The same applies to the second sheet sensor.

The above configuration for making the developing rollers 61 be in contact with and be separated from the respective photosensitive drums 50 is merely an example. For example, while the cams 150 have the crests on the outer peripheral surfaces thereof in the above embodiment, the cams 150 may be end cams. Further; while the cams 150 directly press the respective developing cartridges 60 in the above embodiment, the cams 150 may press members other than the developing cartridges 60. For example, the cams 150 may press cam followers to cause the cam followers to press the developing cartridges 60. Further, while the developing cartridges 60 are supported so as to move in the front and rear directions in the above embodiment, the developing cartridges 60 may be supported so as to move in the up and down directions.

While the image forming apparatus 1 includes the internal tray 21 and the manual feed tray 41 in the above embodiment, the image forming apparatus 1 may include one or more additional trays. For example, the distance between each additional tray and the Y photosensitive drum 50Y along a conveyance path may be longer than the distance between the internal tray 21 and the Y photosensitive drum SOY along the conveyance path. In another example, the image forming apparatus 1 may include the manual feed tray 41 and not include the internal tray 21.

While the image forming apparatus 1 can form an image using the four colors of toner in the above embodiment, the image forming apparatus 1 may form an image using two, three, or five or more colors of toner. The image forming apparatus 1 is not limited to a printer and may be a multi-function peripheral or a copier.

In the embodiment described above, a separation mechanism, such as a pair of a separation roller and a separation pad, is not provided along the path from the manual feed tray 41. However, the image forming apparatus 1 may include such a separation mechanism along the path from the manual feed tray 41. For example, a feed roller and a pair of a separation roller and a separation pad may be provided near a base end part of the manual feed tray 41, In this case, a plurality of sheets can be supported on the manual feed tray 41. If the feed roller picks up one or more sheets, the separation roller and the separation pad separate one sheet from others, and conveys the separated sheet toward the roller 43.

Combination of components and/or combination of steps described above may be appropriately changed.

What is claimed is:

1. An image forming apparatus comprising:

a manual feed tray configured to support a sheet;

a manual feed roller configured to pick up the sheet supported on the manual feed tray to convey the sheet along a conveyance path;

a plurality of photosensitive drums on which electrostatic latent images are capable of being formed, the plurality of photosensitive drums being arranged along the conveyance path on which a sheet is conveyed in a conveyance direction, the plurality of photosensitive drums including a first photosensitive drum and a second photosensitive drum disposed downstream of the first photosensitive drum in the conveyance direction;

a plurality of developing rollers configured to supply respective ones of the plurality of photosensitive drums with toner to form toner images based on the electrostatic latent images, the plurality of photosensitive rollers including a first developing roller and a second developing roller configured to supply corresponding ones of the first photosensitive drum and the second photosensitive drum with toner, each of the plurality of developing rollers being movable between a corresponding contact position at which the each of the plurality of developing rollers contacts a corresponding photosensitive drum and a corresponding separated position at which the each of the plurality of developing rollers is separated from the corresponding photosensitive drum;

a first moving mechanism configured to move the first developing roller from a first contact position to a first separated position and from the first separated position to the first contact position;

a second moving mechanism configured to move the second developing roller from a second contact position to a second separated position and from the second separated position to the second contact position; and a controller configured to perform:

a color print process for printing a color image on a sheet by using the plurality of developing rollers;

a monochrome print process for printing a monochromatic image on a sheet by using only the second developing roller among the plurality of developing rollers;

in a first case where the color print process is executed for printing a color image on a sheet conveyed from the manual feed tray:

controlling the first moving mechanism to start moving the first developing roller from the first separated position toward the first contact position;

controlling the manual feed roller to start picking up the sheet supported on the manual feed tray after the controlling the first moving mechanism is executed; and controlling the second moving mechanism to start moving the second developing roller from the second separated position toward the second contact position after the controlling the manual feed roller is executed; and in a second case where the monochrome print process is executed for printing a monochromatic image on a sheet conveyed from the manual feed tray:

controlling the manual feed roller to start picking up the sheet supported on the manual feed tray; and controlling the second moving mechanism to start moving the second developing roller from the second separated position toward the second contact position after the controlling the manual feed roller is executed.

2. The image forming apparatus according to claim 1, wherein in the first case, the controller is configured to further perform receiving a print job, wherein in the first case, the controller performs the controlling the first moving mechanism to start moving the first developing roller at a time when a first time period elapses since the controller receives the print job, wherein in the first case, the controller performs the controlling the manual feed roller to start picking up the sheet supported on the manual feed tray at a time when a second time period elapses since the first moving mechanism starts moving the developing roller.

3. The image forming apparatus according to claim 2, wherein the second time period is set such that a toner image developed by the first developing roller can be timely transferred to the sheet conveyed from the manual tray if the manual feed roller starts picking up the sheet supported on the manual feed tray at the time when the second time period elapses since the first moving mechanism starts moving the developing roller.

4. The image forming apparatus according to claim 1, further comprising a sheet sensor located upstream of the first photosensitive drum in the conveyance direction on the conveyance path, the sheet sensor being configured to detect presence or absence of a sheet passing thereof and output a resultant signal to the controller, wherein in the first case, the controller is configured to further perform determining that a leading edge of a sheet passes the sheet sensor based on signals from the sheet sensor, wherein the controlling the second moving mechanism to start moving the second developing roller is performed at a time when a time period elapses since the determining is performed.

5. The image forming apparatus according to claim 4, wherein the time period is set such that a toner image developed by the second developing roller can be timely transferred to the sheet conveyed from the manual feed tray if the second moving mechanism starts moving at the time when the time period elapses since the determining is performed.

6. The image forming apparatus according to claim 1, further comprising:

a sheet tray configured to support a sheet; and a feed roller configured to pick up the sheet supported on the sheet tray to convey the sheet toward the plurality of photosensitive drums along a second conveyance path;

wherein a distance between the sheet tray and the first photosensitive drum along the second conveyance path is longer than a distance between the manual feed tray and the first photosensitive drum along the conveyance path, wherein the controller is configured to further perform, in a third case where the color print process is executed for printing a color image on a sheet conveyed from the sheet tray:

controlling the feed roller to start picking up the sheet supported on the sheet tray;

controlling the first moving mechanism to start moving the first developing roller from the first separated position toward the first contact position after the controlling the feed roller is executed; and controlling the second moving mechanism to start moving the second developing roller from the second separated position toward the second contact position after the controlling the first moving mechanism to start moving the first developing roller is executed, wherein the controller is configured to further perform, in a fourth case where the monochrome print process is executed for printing a monochromatic image on a sheet conveyed from the sheet tray:

controlling the feed roller to start picking up the sheet supported on the sheet tray; and controlling the second moving mechanism to start moving the second developing roller from the second separated position toward the second contact position after the controlling the feed roller is executed.

7. The image forming apparatus according to claim 6, further comprising:

a sheet-detection sensor located downstream of the sheet tray and upstream of the first photosensitive drum in the conveyance direction, the sheet-detection sensor being configured to detect presence or absence of a sheet passing thereof and output a resultant signal to the controller, wherein in the third case, the controller is configured to further perform receiving a print job, wherein in the third case, the controlling the feed roller to start picking up the sheet supported on the sheet tray is performed when at a time when a time period elapses since the controller receives the print job, wherein in the third case, the controller is configured to further perform determining that a leading edge of a sheet passes the sheet-detection sensor based on signals from the sheet-detection sensor, wherein in the third case, the controlling the first moving mechanism to start moving the first developing roller from the first separated position toward the first contact position is performed at a time when another time period elapses since the determining is performed.

8. The image forming apparatus according to claim 7, wherein the another time period is set such that a toner image developed by the developing roller can be timely transferred to the conveyed sheet if the first moving mechanism is started when the another time period elapses since the determining is performed.

9. The image forming apparatus according to claim 6, further comprising a housing configured to detachably accommodate the sheet tray, wherein the manual feed tray is located outside of the housing.

10. The image forming apparatus according to claim 1, wherein the plurality of photosensitive drums further includes a third photosensitive drum located between the first photosensitive drum and the second photosensitive drum in the conveyance direction, and a fourth photosensitive drum located between the third photosensitive drum and the second photosensitive drum in the conveyance direction, wherein the plurality of developing rollers further includes a third developing roller and a fourth developing roller configured to supply the third photosensitive drum and the fourth photosensitive drum respectively with toner, wherein the first moving mechanism is configured to further start moving the third developing roller from a third separated position to a third contact position at a time based on a position of the conveyed sheet after the first moving mechanism start moving the first developing roller, wherein the first moving mechanism is configured to further start moving the fourth developing roller from a fourth separated position to a fourth contact position at a time based on a position of the conveyed sheet after the first moving mechanism start moving the third developing roller.

11. An image forming apparatus comprising:

a conveyor configured to convey a sheet along a conveyance path in a conveyance direction;

a sheet tray configured to support a sheet;

a pick-up roller configured to pick up the sheet supported on the sheet tray;

a first photosensitive drum arranged along the conveyance path;

a second photosensitive drum arranged along the conveyance path, the second photosensitive drum disposed downstream of the first photosensitive drum in the conveyance direction;

a first developing roller being movable between a first contact position at which the first developing roller contacts the first photosensitive drum and a first separated position at which the first developing roller is separated from the first photosensitive drum;

a second developing roller being movable between a second contact position at which the second developing roller contacts the second photosensitive drum and a second separated position at which the second developing roller is separated from the second photosensitive drum;

a first moving mechanism configured to move the first developing roller from a first contact position to a first separated position and from the first separated position to the first contact position;

a second moving mechanism configured to move the second developing roller from a second contact position to a second separated position and from the second separated position to the second contact position; and a controller configured to perform:

a color print process for printing a color image on a sheet by using both the first developing roller and the second developing roller;

a monochrome print process for printing a monochromatic image on a sheet by using only the second developing roller;

in a first case where the color print process is executed for printing a color image on a sheet conveyed from the sheet tray:

controlling the first moving mechanism to start moving the first developing roller from the first separated position toward the first contact position;

controlling the pick-up roller to start picking up the sheet supported on the sheet tray after the controlling the first moving mechanism is executed; and controlling the second moving mechanism to start moving the second developing roller from the second separated position toward the second contact position after the controlling the pick-up roller is executed; and in a second case where the monochrome print process is executed for printing a monochromatic image on a sheet conveyed from the sheet tray:

controlling the pick-up roller to start picking up the sheet supported on the sheet tray; and controlling the second moving mechanism to start moving the second developing roller from the second separated position toward the second contact position after the controlling the pick-up roller is executed.

12. An image forming apparatus comprising:

a sheet tray;

a pick-up roller configured to pick up a sheet on the sheet tray;

a first photosensitive drum;

a second photosensitive drum;

a first developing roller being movable between:

a first contact position at which the first developing roller contacts the first photosensitive drum; and a first separated position at which the first developing roller is separated from the first photosensitive drum;

a second developing roller being movable between:

a second contact position at which the second developing roller contacts the second photosensitive drum; and a second separated position at which the second developing roller is separated from the second photosensitive drum; and a controller configured to perform:

when printing image on a sheet picked up from the sheet tray by using both the first developing roller and the second developing roller:

starting moving the first developing roller from the first separated position toward the first contact position;

after starting moving the first developing roller, starting picking up the sheet supported on the sheet tray by the pick-up roller; and after starting picking up the sheet, starting moving the second developing roller from the second separated position toward the second contact position; and when printing image on a sheet picked up from the sheet tray by using only the second developing roller:

starting picking up the sheet supported on the sheet tray by the pick-up roller; and after starting picking up the sheet, starting moving the second developing roller from the second separated position toward the second contact position.

* * * * *